US007405639B2

(12) United States Patent
Yonezawa et al.

(10) Patent No.: US 7,405,639 B2
(45) Date of Patent: Jul. 29, 2008

(54) SWITCH

(75) Inventors: Yu Yonezawa, Yokohama (JP); Naoyuki Mishima, Yokohama (JP); Tadashi Nakatani, Kawasaki (JP); Anh Tuan Nguyen, Kawasaki (JP); Satoshi Ueda, Kawasaki (JP)

(73) Assignees: Fujitsu Media Devices Limited, Yokohama (JP); Fujitsu Limited, Kawasaki (JP)

( * ) Notice: Subject to any disclaimer, the term of this patent is extended or adjusted under 35 U.S.C. 154(b) by 159 days.

(21) Appl. No.: 11/544,017

(22) Filed: Oct. 6, 2006

(65) Prior Publication Data

US 2007/0080764 A1 Apr. 12, 2007

(30) Foreign Application Priority Data

Oct. 7, 2005 (JP) ..... 2005-295654

(51) Int. Cl.
*H01P 1/10* (2006.01)

(52) U.S. Cl. ..... 333/262; 333/105

(58) Field of Classification Search ..... 333/101, 333/105, 262; 335/78, 161, 201, 203
See application file for complete search history.

(56) References Cited

U.S. PATENT DOCUMENTS 7,053,739 B2 * 5/2006 Wakatsuki et al. ..... 335/201

FOREIGN PATENT DOCUMENTS

JP 2004-200008 A 7/2004
JP 2005-243576 A 9/2005

OTHER PUBLICATIONS

Yu Yonezawa et al, "*Fabrication Process of Non Arching Power MEMS Relay*", Technical Report of IEICE, Oct. 21, 2004, The Institute of Electronics, Japan.

* cited by examiner

*Primary Examiner*—Dean O Takaoka
(74) *Attorney, Agent, or Firm*—Arent Fox LLP

(57) ABSTRACT

A switch includes a first member, one end of which being secured to a substrate, multiple first beam portions respectively having multiple first contact portions, one ends of the multiple beam portions being secured to the first member, multiple contact switch portions connected in parallel, the multiple first contact portions and multiple second contact portions being in a contact state or in a non-contact state in the multiple contact switch portions, and resistors arranged respectively between the multiple contact switch portions and a common connection point to which the multiple contact switch portions are coupled. When at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

12 Claims, 20 Drawing Sheets

SWITCH

BACKGROUND OF THE INVENTION

1. Field of the Invention

This invention generally relates to switches, and more particularly, to a switch that is mechanically driven and electrically coupled.

2. Description of the Related Art

In recent years, mobile telephones and mobile information terminals have become widespread very fast, with the advancements of the mobile communications systems. For instance, high frequency ranges such as 800 MHz to 1.0 GHz and 1.5 GHz to 2.0 GHz are used for the mobile telephones. High-frequency switches are for use in the devices in the above-described mobile communications systems. Miniaturization and power saving are demanded for the high-frequency switches. Conventionally, semiconductor switches that include gallium arsenide (GaAs) or the like have been employed. The semiconductor switches, however, lead to a large power loss and a low isolation. For these reasons, the development is in progress for radio frequency MEMS switches (hereinafter, referred to as RF MEMS SW) by use of the technology of microelectromechanical system (MEMS) that enables high isolation.

In Japanese Patent Application Publication No. 2004-200008 (hereinafter, referred to as Document 1) and Japanese Patent Application Publication No. 2005-243576 (hereinafter, referred to as Document 2), there are disclosed RF MEMS SWs whereby switching is done by electrically connecting or disconnecting one contact provided at a movable member with the other contact of a stationary member. In such RF MEMS SW, opening and closing of the switch while current is being applied (hereinafter, referred to as hot switching) consumes electricity at the contacts and generates heat at the contacts, resulting in damage. Approximately 10 mW is the power that can be used in hot switching. Therefore, after the applied current is turned off, the switch is opened and closed (hereinafter, referred to as cold switching). However, opening and closing of the applied current have to be done in synchronization with RF MEMS SW for cold switching, causing a complicated control.

In order to enable hot switching, as disclosed in Document 1, for example, there is provided a configuration in which resistors are arranged in series with multiple contacts connected in parallel. Also, as disclosed in Yonezawa et al., Fabrication Process of Non Arcing Power MEMS Relay, in the Technical Report of IEICE, The Institute of Electronics, Oct. 21, 2004 (hereinafter, referred to as Document 3), a configuration of FIG. 1 is shown. Referring now to FIG. 1, contact switches SW1 through SW5 are connected in parallel with a power supply E and a load-resistor RL, and resistors R1 through R4 are respectively connected in series with the contact switches SW2 through SW5. There is no resistor connected to the contact switch SW1. With such configuration, when the switches are turned on, the contact switches SW2 through SW5 are in a contact state and the contact switch SW1 is then in a contact state. By contrast, when the switches are turned off, the contact switch SW1 is in a non-contact state and the contact switches SW2 through SW5 are then in a non-contact state. The afore-described operation is known to improve power durability when the switch is opened and closed while direct current is being applied, as disclosed in Document 3.

Time control is necessary for multiple contact switches in a simple method in order to accomplish hot switching in RF MEMS SW which miniaturization is demanded, by use of the methods described in Document 1 and Document 3. Neither Document 1 nor Document 3, however, disclose a specific configuration, whereby the time control for multiple contact switches is accomplished by a simple method.

SUMMARY OF THE INVENTION

The present invention has been made in view of the above circumstances and provides a switch that enables hot switching with a simple configuration.

According to one aspect of the present invention, there is provided a switch including: a first member, one end of which being secured to a substrate; multiple first beam portions respectively having multiple first contact portions, one ends of the multiple beam portions being secured to the first member; multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled, wherein when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state. It is possible to suppress the peak of the power consumption of the contact switch portions during the ON operation period and suppress the meltdown of the contact switch portions. In addition, the first beam portions serve as springs, allowing the multiple contact switch portions to be in a contact state smoothly. With such a simple configuration, hot switching is enabled.

According to another aspect of the present invention, there is provided a switch including: multiple first beam portions respectively having multiple first contact portions, one ends of the multiple beam portions being secured to the first member; multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled. At least one of the multiple first contact points and the multiple second contact portions have different heights; and when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

According to yet another aspect of the present invention, there is provided a switch including: multiple first beam portions respectively having multiple first contact portions, one ends of the multiple beam portions being secured to the first member; multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled. The multiple first contact portions and the multiple second contact portions are in a contact state or in a non-contact state in an arrangement direction of the contact switch portions; and when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

According to further another aspect of the present invention, there is provided a switch including: multiple contact switch portions connected in parallel and being in a contact state or in a non-contact state by sliding at least one of a first contact portion and multiple second contact portions in an arrangement direction of the multiple second contact portions; and resistors arranged respectively between the multiple contact switch portions and a common connection point to which the multiple contact switch portions are coupled. When at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

BRIEF DESCRIPTION OF THE DRAWINGS

Preferred exemplary embodiments of the present invention will be described in detail with reference to the following drawings, wherein.

DESCRIPTION OF THE PREFERRED EMBODIMENTS

A description will now be given, with reference to the accompanying drawings, of exemplary embodiments of the present invention.

First Exemplary Embodiment

Figure 1:
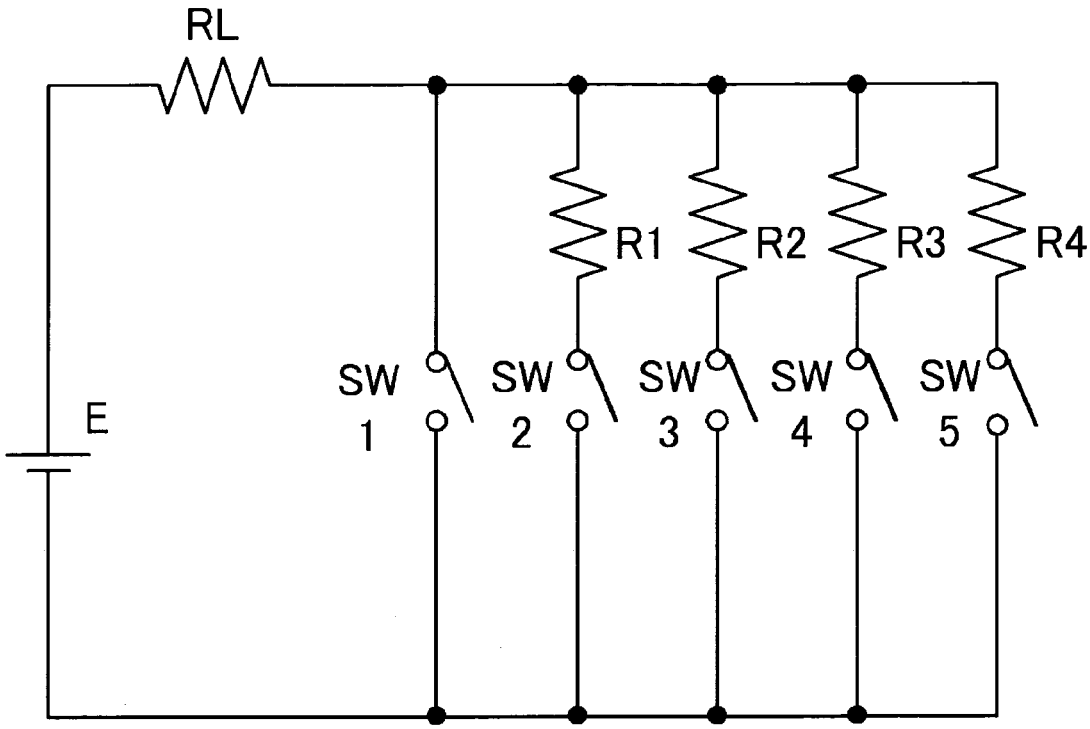
FIG. 1 illustrates a circuit configuration of a switch of a conventional example.
Figure 2:
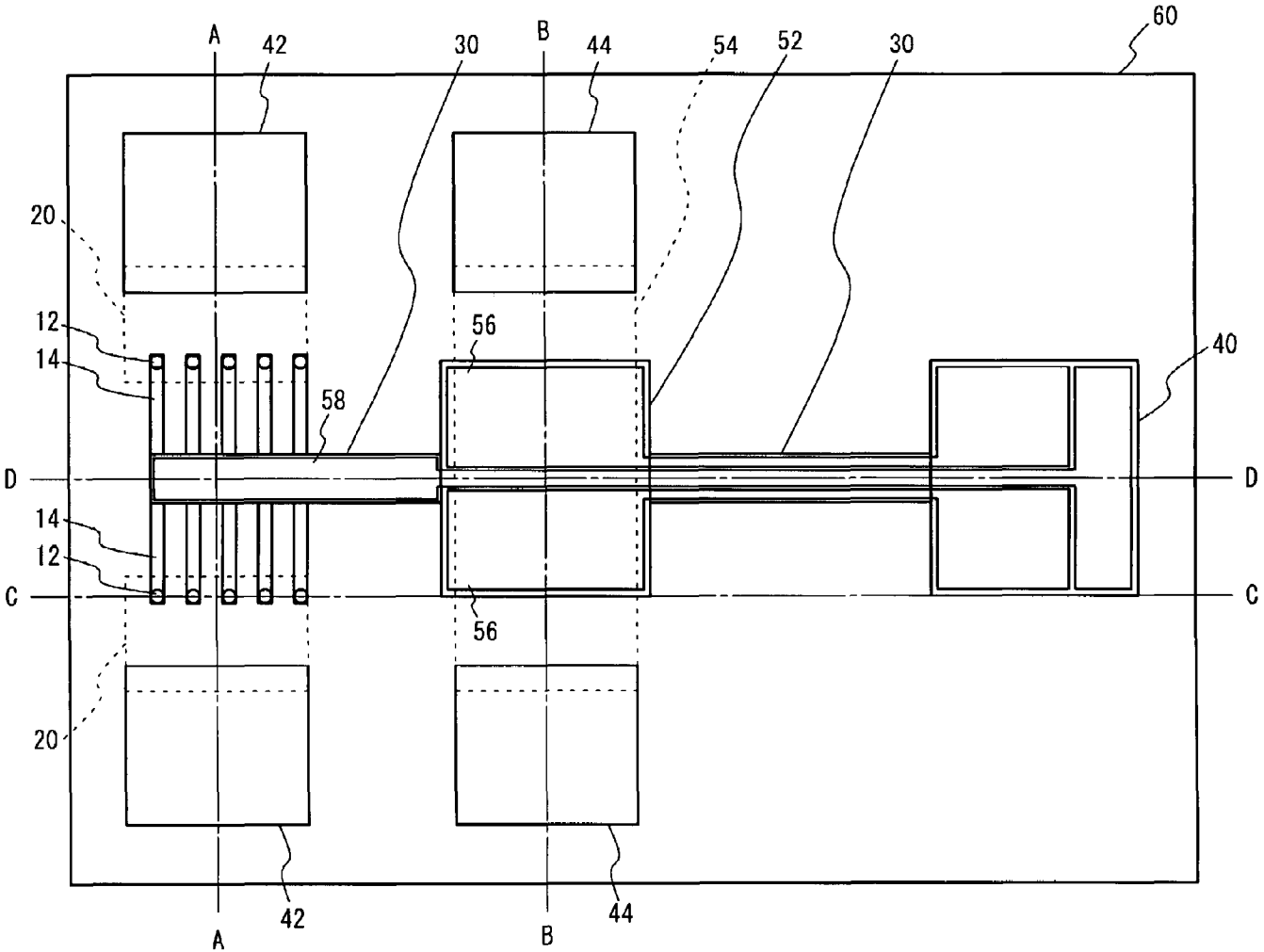
FIG. 2 is a top view of a switch in accordance with a first exemplary embodiment of the present invention (resistance metal films or low-resistance metal films are not shown)
Figure 3:
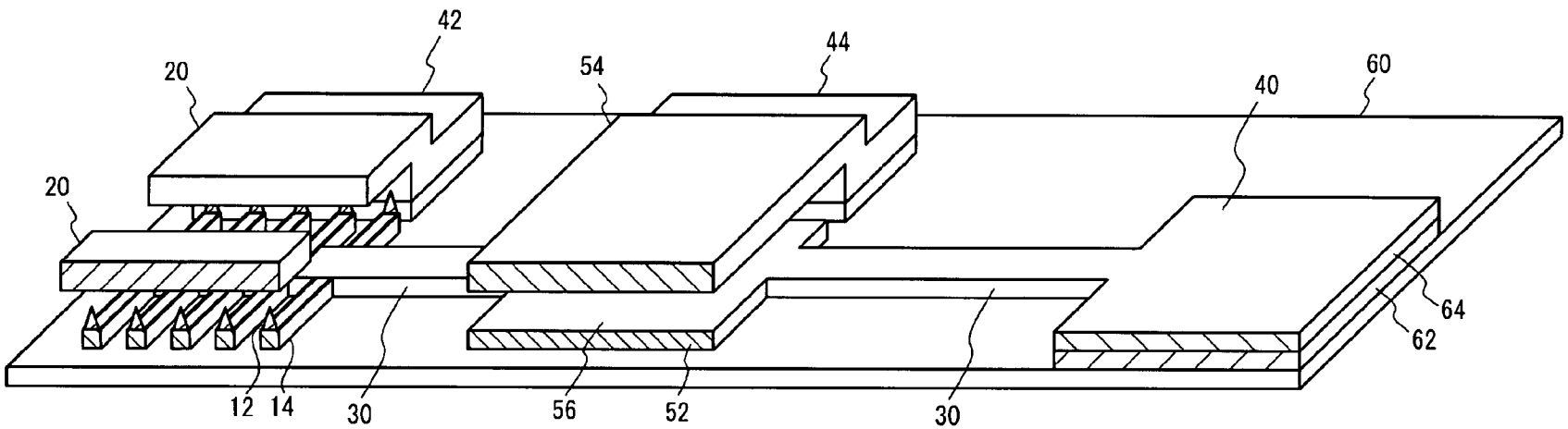
FIG. 3 is a perspective cross-sectional view taken along the line A-A shown in FIG. 2 (the resistance metal films, the low-resistance metal films, lower electrode metal films, or an extraction metal film are not shown)
Figures 4A, 4B, 4C, 4D:
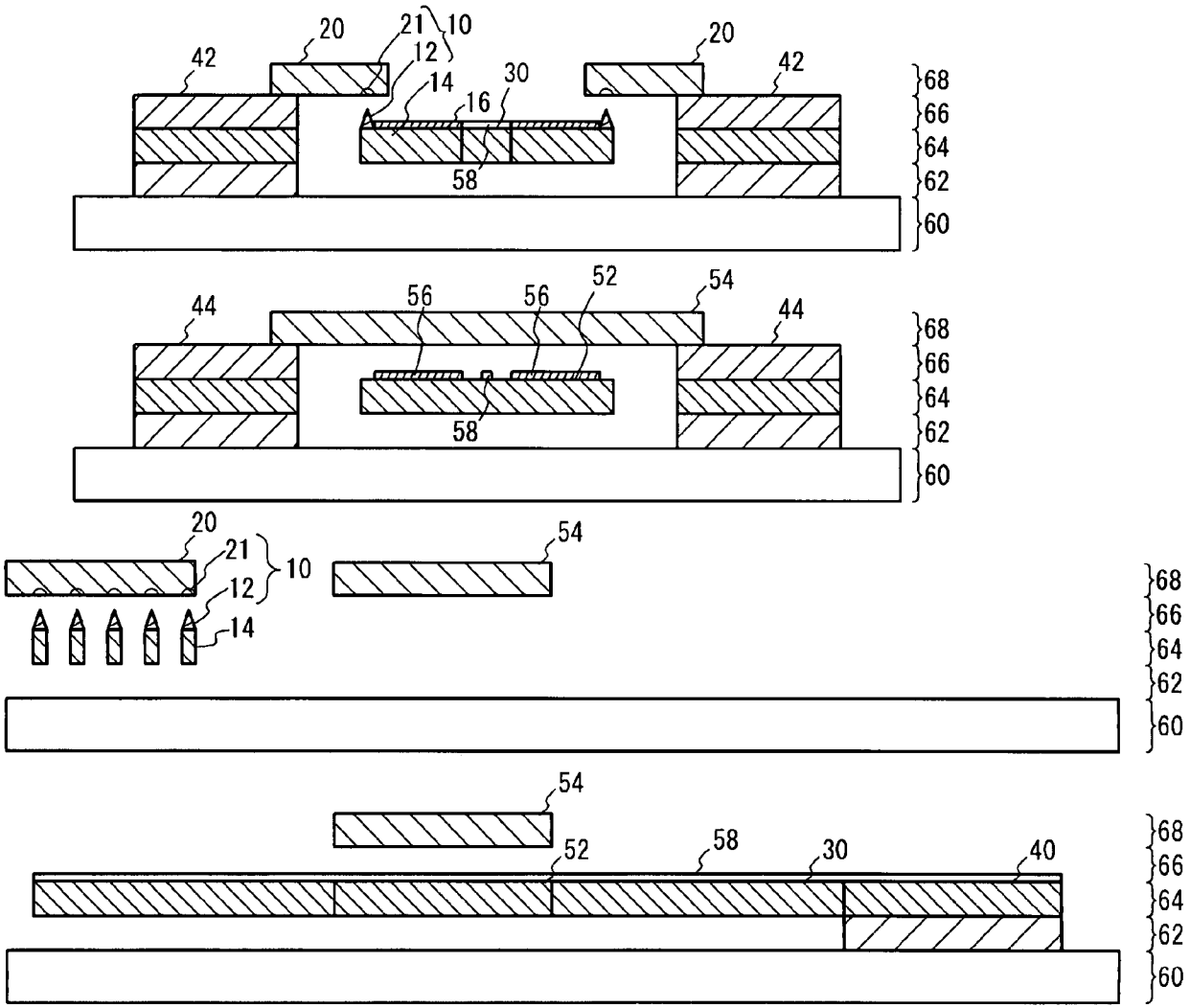
FIG. 4A through FIG. 4D are cross-sectional views respectively taken along the lines A-A, B-B, C-C, and D-D shown in FIG. 2.
Figure 5:
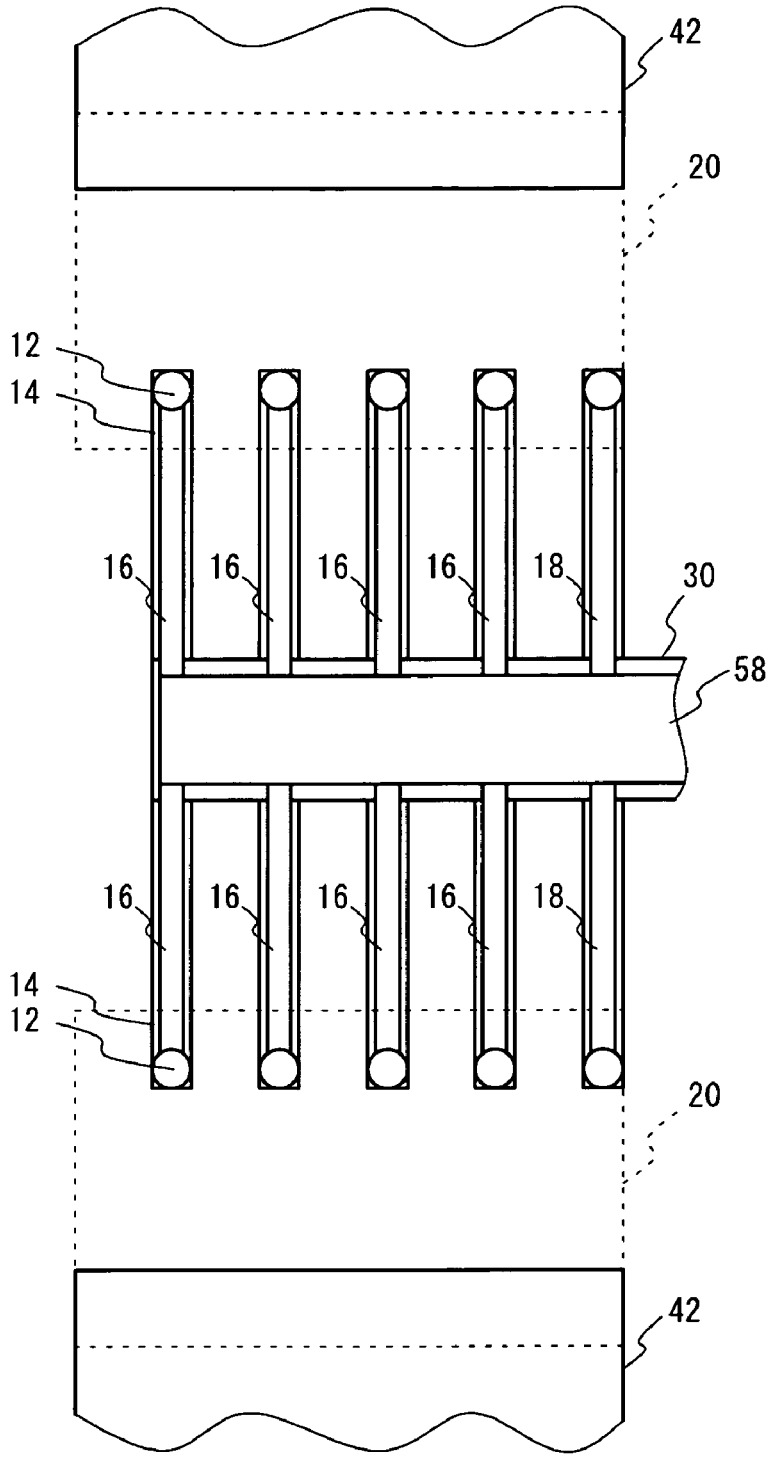
FIG. 5 is an enlarged view of first contact portions shown in FIG. 2

A switch employed in a first exemplary embodiment is an example has a first member, one end of which is secured to a substrate. A description will be given, with reference to FIG. 2 through FIG. 5, of the configuration of the switch employed in the first exemplary embodiment. FIG. 2 is a top view of the switch in accordance with the first exemplary embodiment of the present invention. In FIG. 2, resistance metal films 16 and low-resistance metal films 18 are not shown, whereas an electrostatically-driven upper electrode 54 and second members 20 are indicated by dotted lines. FIG. 3 is a perspective cross-sectional view taken along the line A-A shown in FIG. 2. In FIG. 3, there are not shown the resistance metal films 16, the low-resistance metal films 18, lower electrode metal films 56, and an extraction metal film 58. FIG. 4A through FIG. 4D are cross-sectional views respectively taken along the lines A-A, B-B, C-C, and D-D shown in FIG. 2. FIG. 5 is an enlarged view of first contact portions 12 shown in FIG. 2.

Referring now to FIG. 4A through FIG. 4D, the switch employed in the first exemplary embodiment has a silicon-on-insulator (SOI) structure where there are provided a silicon substrate 60, a silicon oxide layer 62, and a silicon layer 64. On top thereof, metal layers 66 and 68 are stacked. The silicon substrate 60 is, for example, 600 μm thick, and the silicon oxide layer 62, the silicon layer 64, the metal layers 66 and 68 are respectively, for example, 4 μm thick, 15 μm thick, 20 μm thick, and 20 μm thick. The silicon substrate 60, the silicon oxide layer 62, and the silicon layer 64 may be processed by the methods described in, for example, Document 1, Document 2, and Document 3. Next, a sacrifice layer is formed and the metal layers 66 and 68 are then formed by, for example, gold plating. After that, the following configuration can be fabricated by removing the sacrifice layer.

As shown in FIG. 2, fixing portions 40, 42, and 44 are arranged on the silicon substrate 60. The afore-mentioned fixing portions are made up of the silicon oxide layer 62 and the silicon layer 64 as shown in FIG. 4A through FIG. 4D. As shown in FIG. 2, FIG. 3, and FIG. 4D, a first member 30 made up of the silicon layer 64 extends from the fixing portion 40, and is not supported by any other part than the fixing portion 40. An electrostatically-driven lower electrode 52 made up of the silicon layer 64 is arranged near the center of the first member 30. The lower electrode metal films 56 are formed on the electrostatically-driven lower electrode 52 by, for example, gold plating. The lower electrode metal films 56 are continuously formed on the first member 30 and on the fixing portion 40, interposing the extraction metal film 58 therebetween. This allows the switch to be electrically coupled to the outside. An electrostatically-driven upper electrode 54 made up of the metal layer 68 is arranged above the electrostatically-driven lower electrode 52. As shown in FIG. 2, FIG. 3, and FIG. 4B, the electrostatically-driven upper electrode 54 is secured to the silicon substrate 60 by the fixing portions 44 at both sides of a width direction of the first member 30.

As shown in FIG. 2, FIG. 3, FIG. 4A, and FIG. 5, multiple beam portions 14 are provided near the end of the first member 30 such that conic first contact portions 12 are arranged at the edges of the beam portions 14. The first contact portions 12 are made up of the silicon layer 64 or the metal layer 66. The method disclosed in Document 3 is employed for fabricating the first contact portions 12 with a silicon layer. Gold plating is employed for fabricating the first contact portions 12 with a metal. As shown in FIG. 5, the resistance metal films 16 connected to the first contact portions 12 are deposited on the beam portions 14 by, for example, a vapor deposition method. The low-resistance metal films 18 are formed on some of the beam portions 14, in a similar manner as the extraction metal film 58, described later. The resistance metal films 16 are connected to the extraction metal film 58 provided on the first member 30. The extraction metal film 58 is provided on the first member 30 and on the fixing portion 40. This allows the first contact portions 12 to be electrically coupled to the outside. As shown in FIG. 2, FIG. 3, FIG. 4, FIG. 4C, and FIG. 5, the second members 20 made up of the metal layer 68 are arranged above the first contact portions 12. The second members 20 include second contact portions 21 in which the first contact portions 12 are in a contact state. The first contact portions 12 and the second contact portions 21 compose a contact switch portion 10, where the first contact portions 12 and the second contact portions 21 are in a contact state or in a non-contact state. As shown in FIG. 2, FIG. 3, and FIG. 4A, the second members 20 are secured to the silicon substrate 60 by the fixing portion 42.

Figure 6:
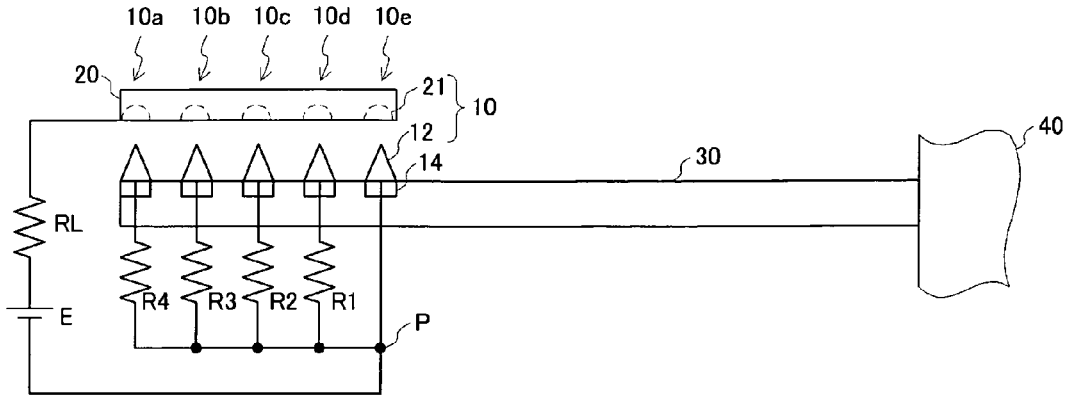
FIG. 6 schematically shows the switch operation in accordance with the first exemplary embodiment of the present invention.

FIG. 6 schematically shows the switch operation in accordance with the first exemplary embodiment of the present invention. The switch employed in the first exemplary embodiment includes: the first member 30 secured to the silicon substrate 60 at one end thereof; and the multiple beam portions 14 (first beam portion) having the first contact portions 12 and secured to the first member 30 at one ends thereof. The second members 20 are provided with multiple second contact portions 21. Contact switch portions 10*a* through 10*e* are connected in parallel, and the first contact portions 12 and the second contact portions 21 are in a contact state or in a non-contact state in the contact switch portions 10*a* through 10*e*. There are also provided: a common connection point P coupled to multiple contact switch portions 10*a* through 10*e*; and resistors R1 through R4 made up of the resistance metal films 16 and respectively arranged between the common connection point P and the contact switch portions 10*a* through 10*e*. The contact switch portion 10*e* is coupled through the low-resistance metal film 18 to the common connection point P, and has a lower resistance value than other contact switch portions. The power supply E and the load-resistor RL are connected in series with the common connection point P. The first contact portions 12 have substantially identical heights.

Figure 7A:
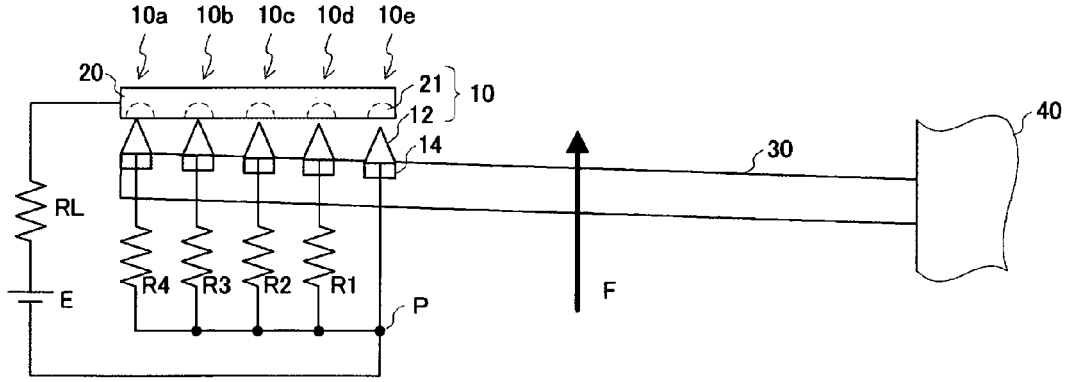
FIG. 7A and FIG. 7B schematically shows the switch operation in accordance with the first exemplary embodiment of the present invention.

FIG. 7A schematically shows the first member 30 shown in FIG. 6 moves upward. In FIG. 7A, the same components and configurations as those shown in FIG. 6 have the same reference numerals and a detailed explanation will be omitted. By supplying voltages of different polarities to the lower electrode metal film 56 and the electrostatically-driven upper electrode 54, a force F is exerted upward on the first member 30. Next, the first member 30 rotates with the fixing portion 40 being centered, and the first member 30 tilts. Then, the first contact portion 12 is firstly in contact with the second contact portion 21 at the contact switch portion 10*a*. At this time, the other contact switch portions 10*b* through 10*e* are in a non-contact state. The resistance value of the resistor corresponding to the contact switch portion 10*e* that is in a non-contact state, namely, the resistance value of the low-resistance metal film 18 is smaller than that of the resistor R1 corresponding to the contact switch portion 10*a* that is in a contact state. Distances between the first contact portions 12 and the second contact portions 21 at the contact switch portions 10*b* through 10*e* are respectively different, being greater in the order of the contact switch portions 10*b* through 10*e*. As the first member 30 tilts more, the contact switch portions 10*b* through 10*e* are sequentially in a contact state.

Figure 7B:
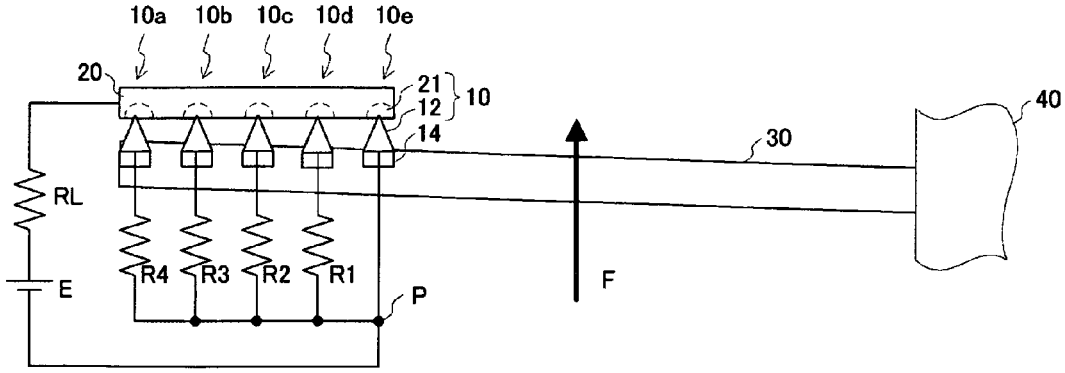

FIG. 7B schematically shows all the contact switch portions 10*a* through 10*e* that are in a contact state. In FIG. 7B, the same components and configurations as those shown in FIG. 6 have the same reference numerals and a detailed explanation will be omitted. The beam portions 14 serve as springs at the first contact portions 12 of the contact switch portions 10*a* through 10*d*, which have been already in a contact state, and all the first contact portions 12 can be in contact with the second contact portions 21. The switch is in an "ON" state, in this manner.

In contrast, when the switch is in an "OFF" state, the voltages applied to the lower electrode metal film 56 and the electrostatically-driven upper electrode 54 are shut off. Next, the force applied onto the first member 30 is lost. Then, the first contact portions 12 of the contact switch portions 10*e* through 10*a* are sequentially in a non-contact state from the second contact portions 21. When all the first contact portions 12 are in a non-contact state from the second contact portions 21, the switch is in an "OFF" state.

Figure 8:
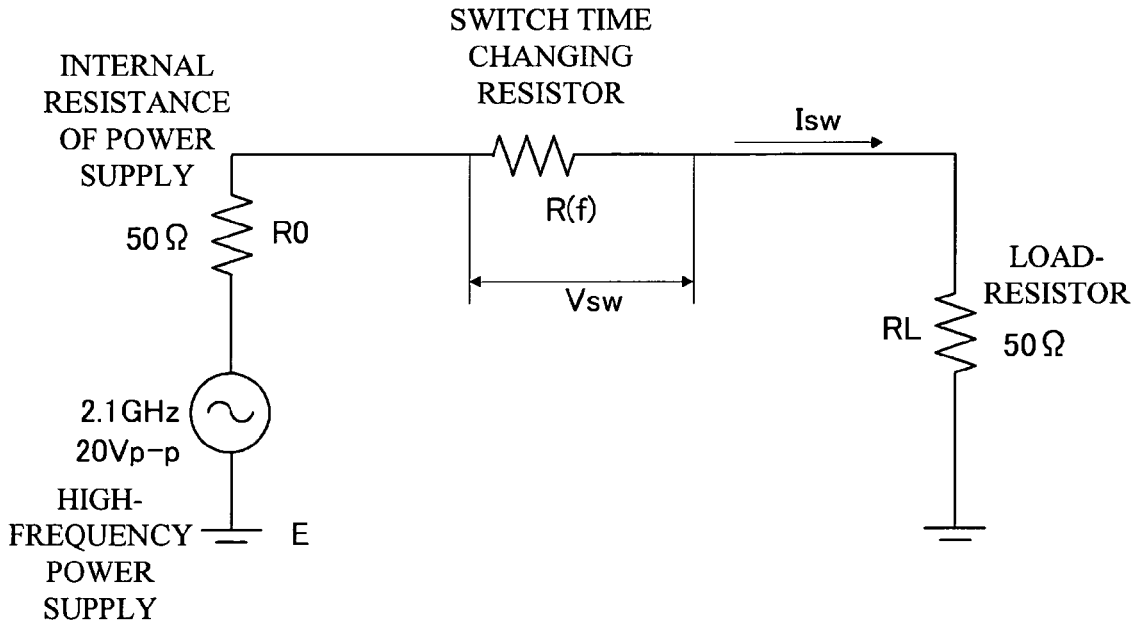
FIG. 8 is an equivalent circuit of the switch of a comparative example.

A description will now be given of calculation results of the effects of the switch employed in the first exemplary embodiment of the present invention. Firstly, a comparative example will be described. FIG. 8 is an equivalent circuit of the switch of the comparative example. In the comparative example, an internal resistor R0 of 50Ω is connected to a high-frequency power source of 2.1 GHz, and is coupled through a switch time changing resistor R(t) to the load-resistor RL of 50Ω. Here, Vsw represents a voltage at both ends of the switch time changing resistor R(t), and Isw represents current flowing across the switch time changing resistor R(t). The switch in an "ON" state denotes that the switch time changing resistor R(t) has a low resistance. The switch in an "OFF" state denotes that the switch time changing resistor R(t) has a high resistance value.

Figure 9:
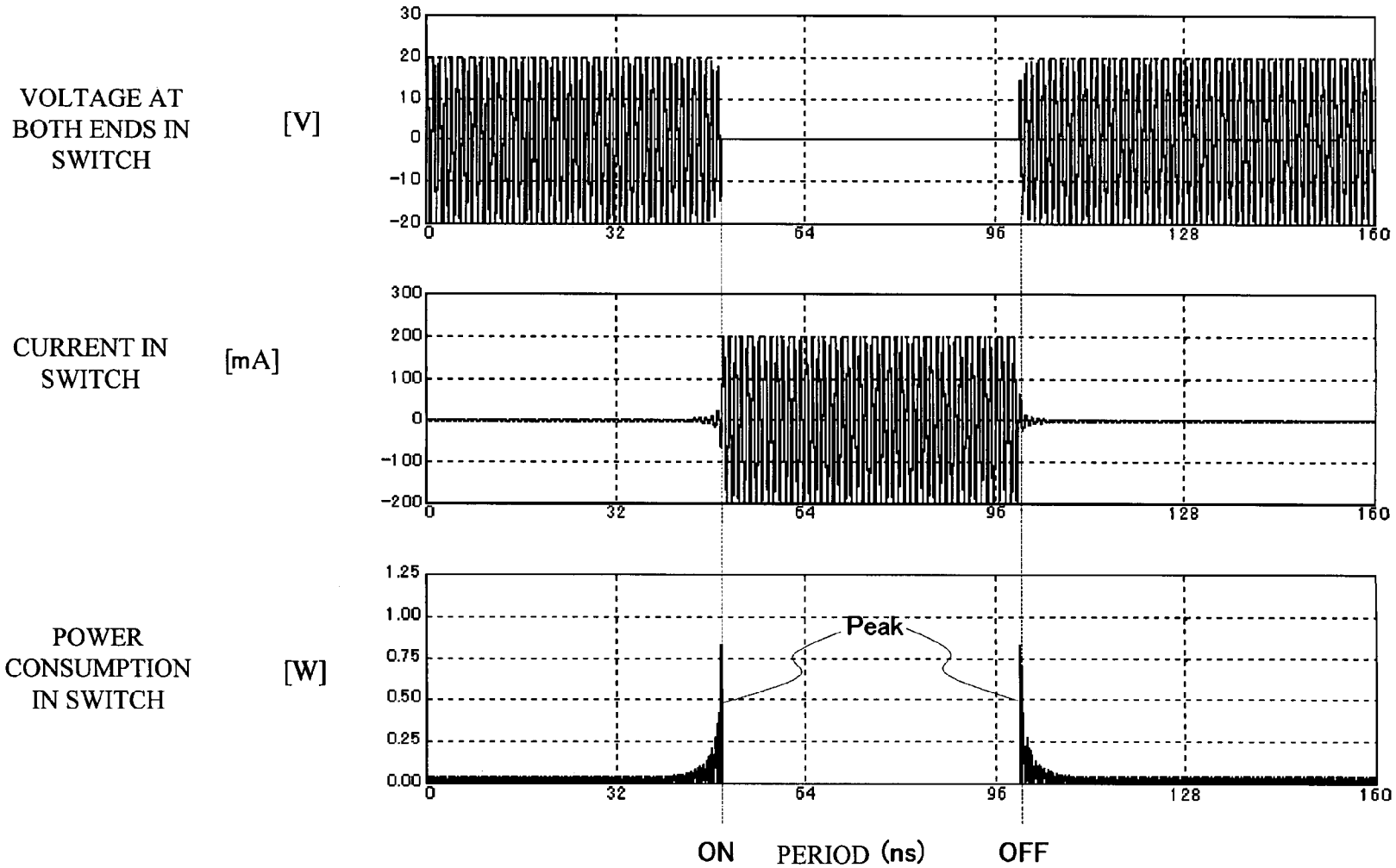
FIG. 9 is a view showing the voltage at both ends of the switch Vsw, the switch current Isw, and the calculation results of switch power consumption in the switch of the comparative example.

FIG. 9 is a view showing the voltage at both ends of the switch Vsw, the switch current Isw, and the calculation results of switch power consumption. Until the switch is turned on, +−20 V of Vsw is supplied at the peak and the current Isw is not flown. At the same time when the switch is turned on, the voltage Vsw becomes 0 V, and the current Isw of +−200 mA is flown at the peak. When the switch is turned off, the voltage Vsw of +−20 V is again supplied at the peak, and the current Isw is not flown. When the switch is turned on or off, the switch power consumption has a peak of 0.8 W. The contact switch portions melt down in the comparative example.

Figure 10:
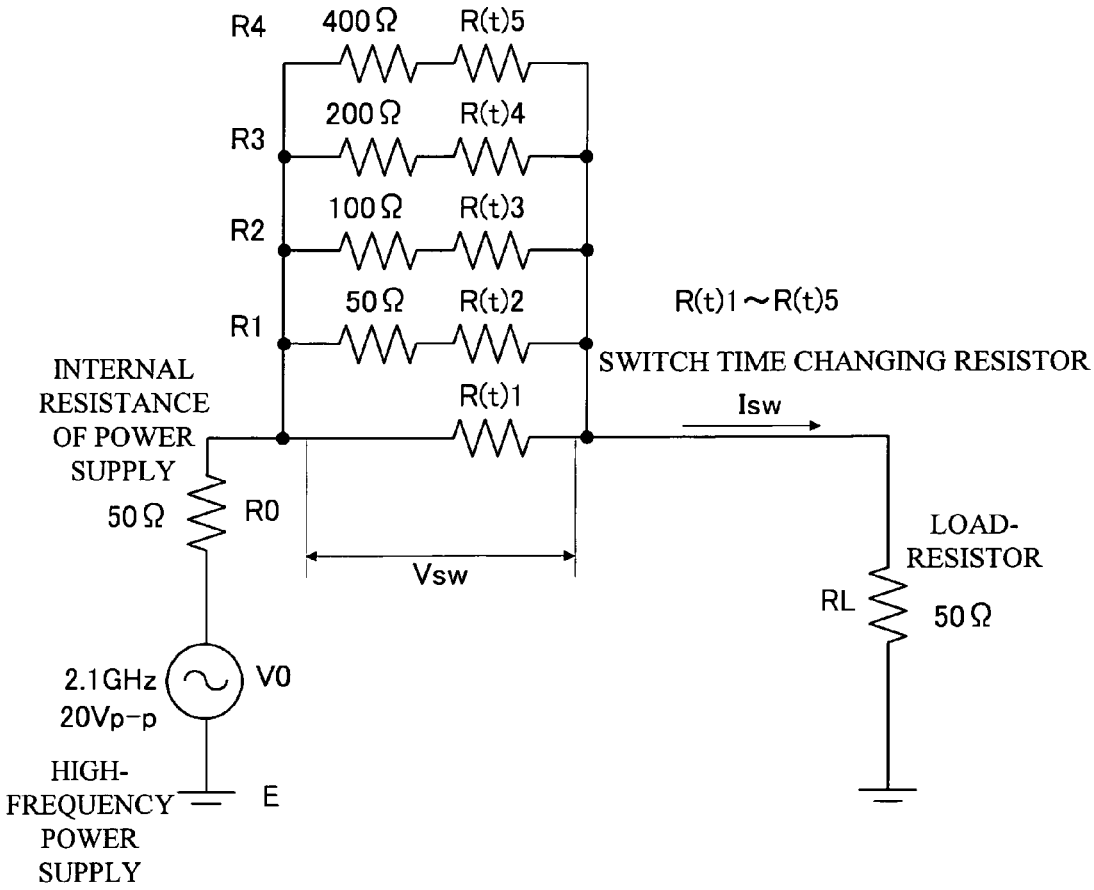
FIG. 10 shows an equivalent circuit of the switch employed in the first exemplary embodiment of the present invention.
Figure 11:
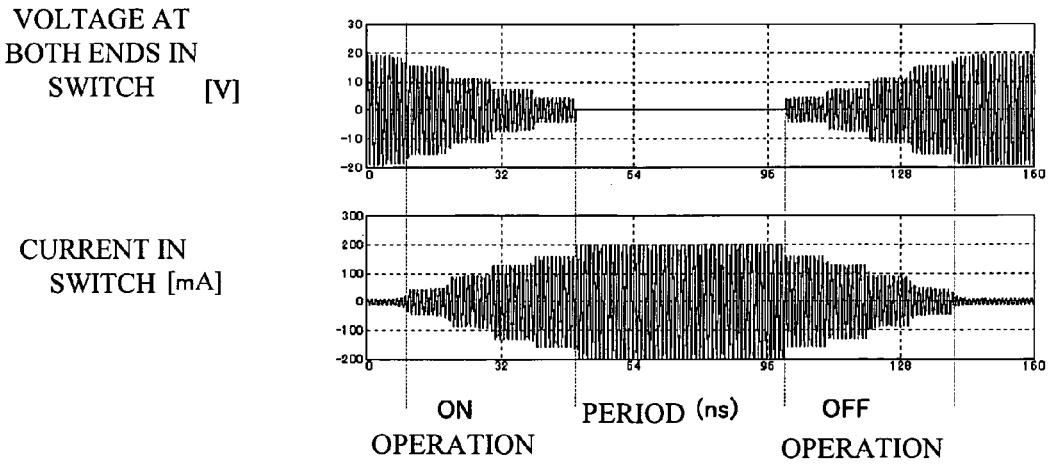
FIG. 11 is a view showing the voltage at both ends of the switch Vsw, the switch current Isw, and the calculation results of switch power consumption in the switch employed in the first exemplary embodiment.

FIG. 10 shows an equivalent circuit of the switch employed in the first exemplary embodiment of the present invention. In FIG. 10, the same components and configurations as those shown in FIG. 8 have the same reference numerals and a detailed explanation will be omitted. In lieu of the switch time changing resistor R(t), switch time changing resistors R(t)1 through R(t)5 corresponding to the multiple contact switch portions 10*e* through 10*a* are connected in parallel. The resistors R1 through R4 are connected in series with the switch time changing resistors R(t)2 through R(t)5 . The resistors R1 through R4 are respectively 50Ω, 100Ω, 200Ω, and 400Ω. Such different resistors are formed by changing the thickness or width of the resistance metal films 16 shown in FIG. 5. The contact switch portions 10*a* through 10*e* are sequentially in a contact state to be in an "ON" state in FIG. 7A and FIG. 7B. This corresponds to the switch time changing resistors R(t)5 through R(t)1 that sequentially have low resistances. This period is ON operation period. Meanwhile, the contact switch portions 10*e* through 10*a* are sequentially in a non-contact state to be in an "OFF" state. This corresponds to the switch time changing resistors R(t)1 through R(t)5 that sequentially have high resistances. This period is OFF operation period.

Figure 12:
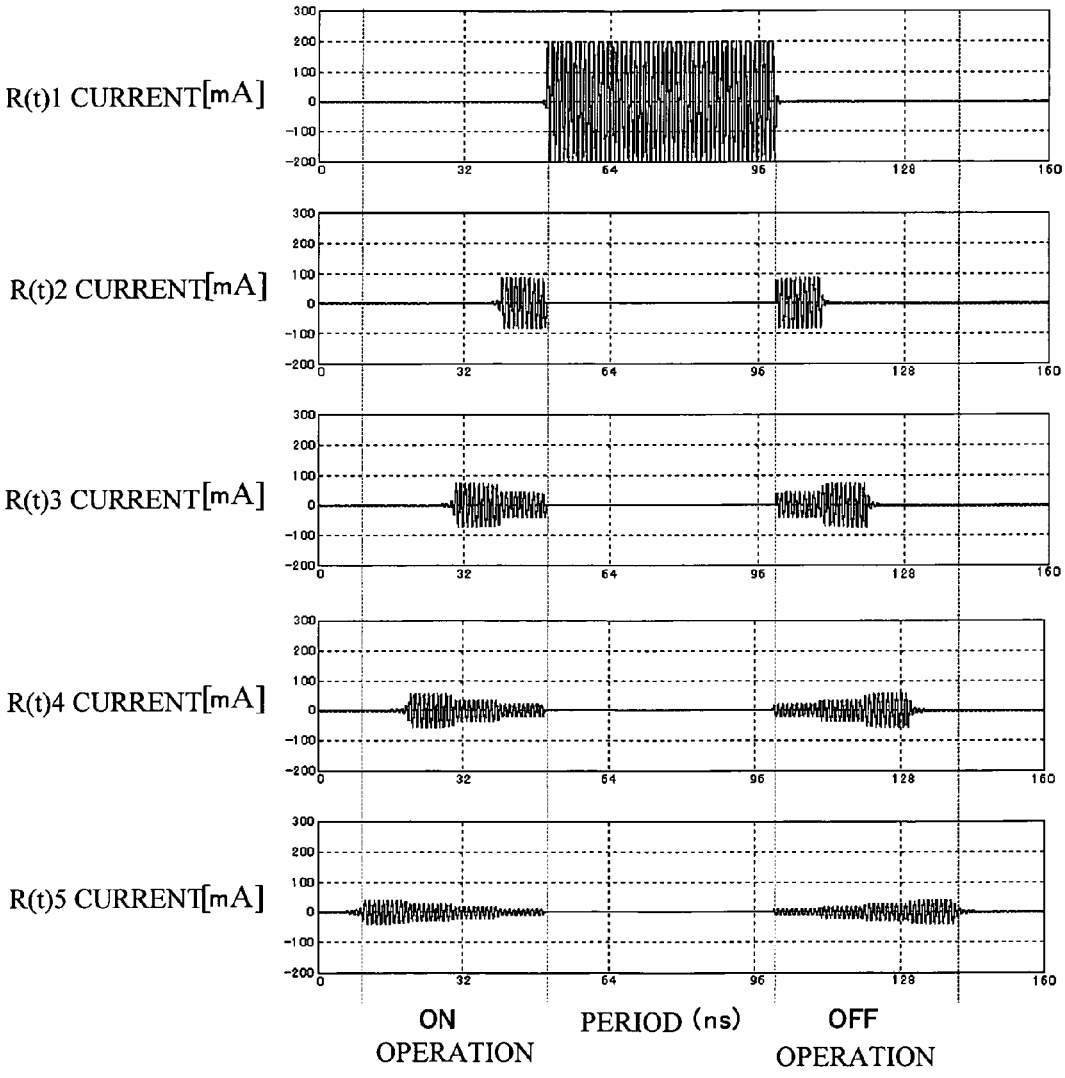
FIG. 12 shows currents flowing across the switch contact portions with respect to time.

FIG. 12 shows currents flowing across the switch time changing resistors R(t)1 through R(t)5 with respect to time. During the ON operation period, current is firstly flown across the switch time changing resistor R(t)5 , and current is sequentially flown across the switch time changing resistor R(t)4 through R(t)1. During the OFF operation period, behaviors symmetrical to those during the ON operation period are demonstrated.

Figure 13:
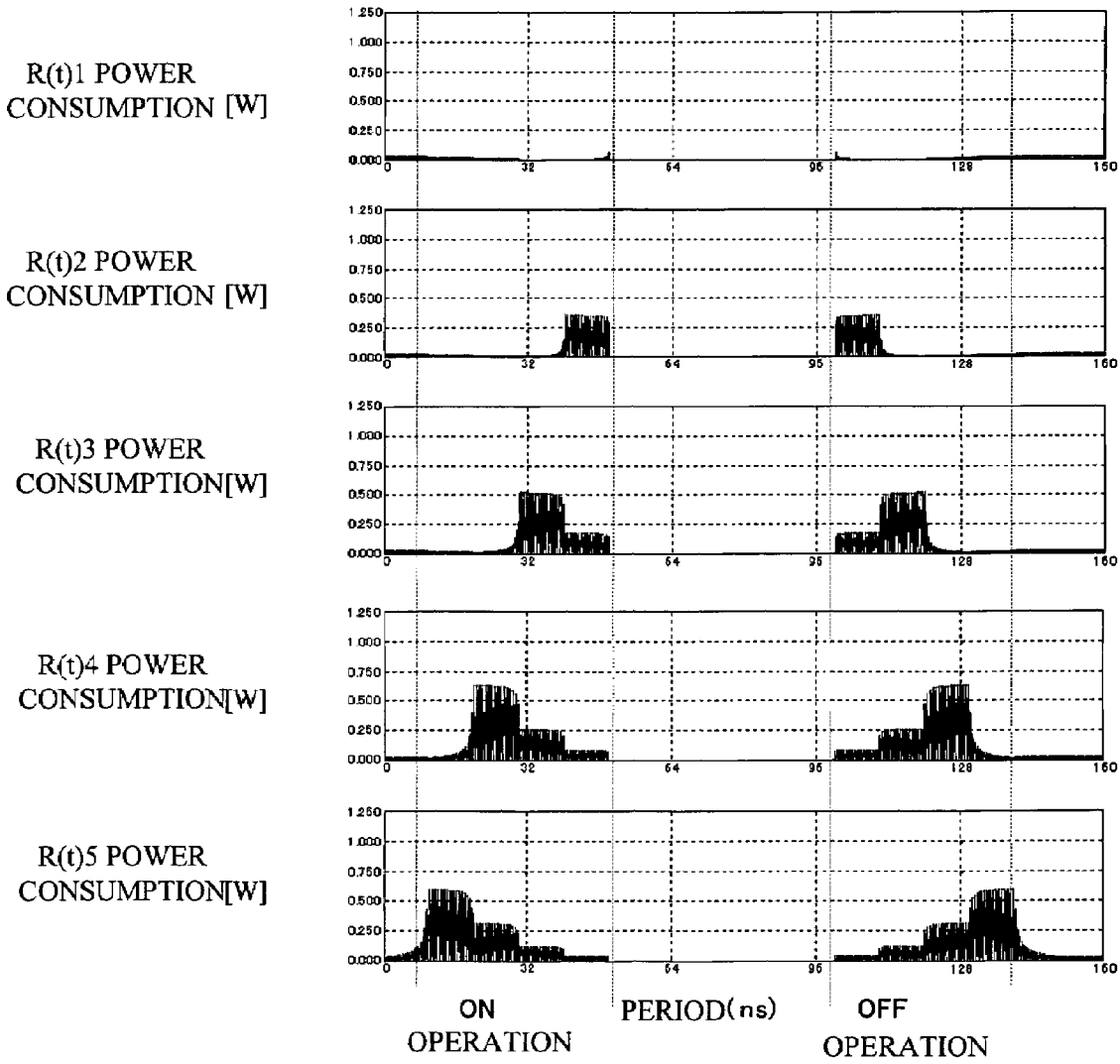
FIG. 13 shows power consumption of the switch contact portions with respect to time.

FIG. 13 shows power consumption of the switch time changing resistors R(t)1 through R(t)5 with respect to time. In a similar manner as shown in FIG. 12, during the ON operation period, power is firstly consumed at the switch time changing resistor R(t)5, and power is sequentially consumed from the switch time changing resistors R(t)4 to R(t)1. During the OFF operation period, behaviors symmetrical to those during the ON operation period are demonstrated. As shown in FIG. 12, while current is being flown across the switch time changing resistor R(t)1, current scarcely flows across the switch time changing resistors R(t)5 through R(t)2 . At this time, no power is consumed as shown in FIG. 13. This is because no resistor is connected in series with the switch time changing resistor R(t)1. While the switch is in "ON" state, no power is consumed as described. Also, the peak of the power consumption is 0.1 W or less in FIG. 13, whereas the peak of the power consumption is 0.8 W in the comparative example in FIG. 9. This demonstrates that neither the first contact portions 12 nor the second contact portions 21 melt down. Although power is consumed in the switch time changing resistors R(t)5 through R(t)2 , such power is consumed at the resistors R1 though R4, which does not lead to the meltdown of the contact switch portions in the comparative example.

The switch employed in the first exemplary embodiment has the first member 30, one end of which is fixed, as shown in FIG. 7B. When at least one of the multiple contact switch portions 10*a* through 10*e*, namely, the contact switch portion 10*a* is in a contact state, there are the contact switch portions 10*b* through 10*e* that are in a non-contact state. The low-resistance metal film 18 is the resistor that corresponds to at least one of the contact switch portions 10*b* through 10*e* that are in a non-contact state, namely, the contact switch portion 10*e* and the resistance value thereof is lower than that of the resistor R4 corresponding to the contact switch portion 10*a*. As shown in FIG. 13, it is therefore possible to suppress the peak of the power consumption at the contact switch portions during the ON operation period, suppressing the meltdown of the contact switch portions. In other words, hot switching can be accomplished. Also, one ends of the first contact portions 12 are provided at the beam portions 14 (first beam portion) secured to the first member 30. The beam portions 14 serve as springs as shown in FIG. 7B, thereby making it possible to connect the multiple contact switch portions 10 smoothly. With such a simple configuration, hot switching can be accomplished.

As shown in FIG. 7B, when the contact switch portion 10*a* is in a contact state, the surface of the first member 30 on which the first contact portions 12*a* through 12*e* are arranged tilts toward the surface on which the second contact portions 21 are arranged. Even if the multiple first contact portions 12 have substantially identical heights, the first contact portions 12 can be sequentially in a contact state to the second contact portions 21. This allows the contact portions 10*a* through 10*e* to be sequentially in a contact state, further suppressing the meltdown of the contact switch portion 10 during the ON operation period.

Also as shown in FIG. 7B, the first member 30 moves in a direction substantially perpendicular to the surface of the silicon substrate 60, and multiple first contact portions 12 and multiple second contact portions 21 move in a direction substantially perpendicular to the surface of the silicon substrate 60, and are in a contact state or in a non-contact state. In addition, as shown in FIG. 2, multiple contact switch portions 10 are arranged in a direction of the fixing portion 40 of the first member 30 and the contact switch portions 10. As shown in FIG. 7B, when the contact switch portion 10*a* is connected by driving the first member 30, the surface of the first member 30 having multiple first contact portions 12*a* through 12*e* thereon tilts toward the second contact portions 21. Here, substantially perpendicular denotes being perpendicular in a range that allows the tilt when the first member 30 rotates with the fixing portion 40 being centered.

Furthermore, as shown in FIG. 10, the resistors R1 through R4 have smaller resistances in the order of the corresponding contact switch portions that are in a contact state. This configuration can suppress the peak of the power consumption at the contact switch portion during the ON operation period, thereby further suppressing the meltdown of the contact switch portions.

When one of the multiple contact switch portions 10*a* through 10*e*, namely, the contact switch portion 10*e* is in a non-contact state, the resistance values of the resistors R4 through R1 corresponding to at least one of the contact switch portions 10*a* through 10*d* that are in a contact state are greater than that of the resistor (the low-resistance metal film 18) corresponding to the contact switch portion 10*e* that are in a non-contact state. This makes it possible to suppress the peak of the power consumption at the contact switch portions during OFF operation period, and thereby suppressing the meltdown of the contact switch portions.

Second Exemplary Embodiment

Figure 14A:
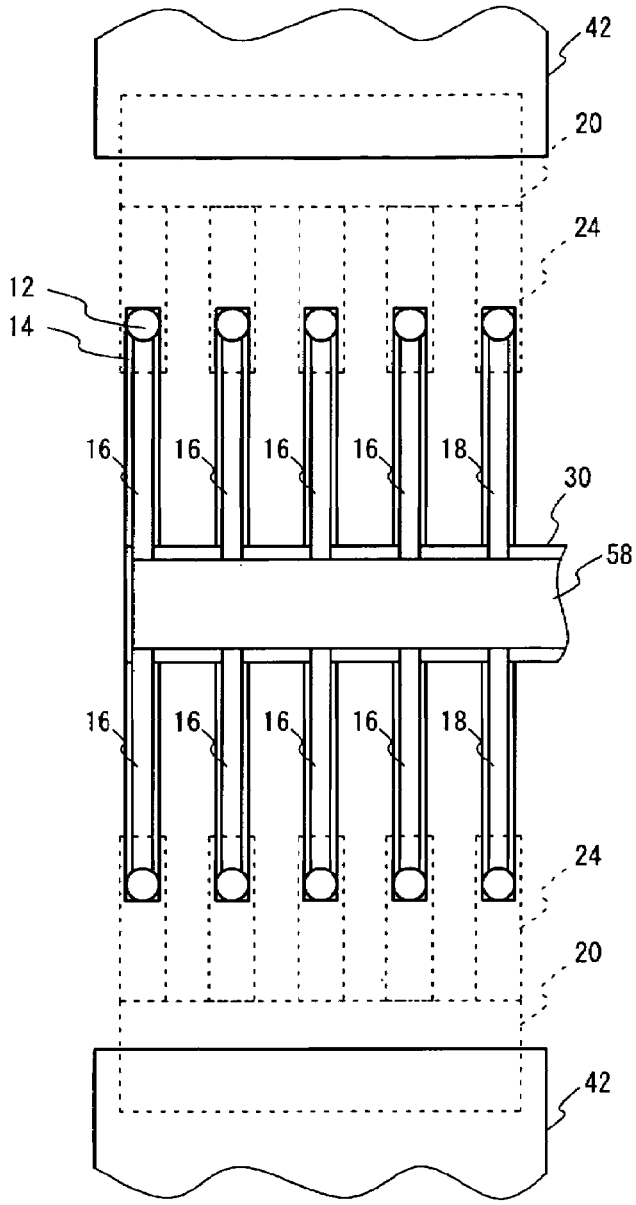
FIG. 14A is a top view of the first contact portions and the second contact portions in the switch employed in a second exemplary embodiment.
Figure 14B:
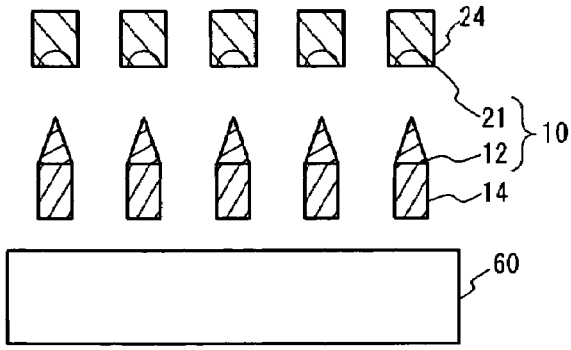
FIG. 14B is a cross-sectional view of the contact switch portion.

A second exemplary embodiment of the present invention is an example in which the second contact portions 21 are provided in beam portions 24. FIG. 14A is a top view of the first contact portions 12 and the second contact portions 21 in the switch employed in the second exemplary embodiment. FIG. 14B is a cross-sectional view of the contact switch portion 10. In FIG. 14A and FIG. 14B, the same components and configurations as those shown in FIG. 5 have the same reference numerals and a detailed explanation will be omitted. There are provided multiple beam portions 24 (second beam portion), made of a metal, in which multiple second contact portions 21 are respectively provided, and one ends of which are secured to the second member 20. The second member 20 is secured to the silicon substrate 20 by the fixing portion 42. The first contact portions 12 and the second contact portions 21 compose the contact switch portions 10.

Figure 15:
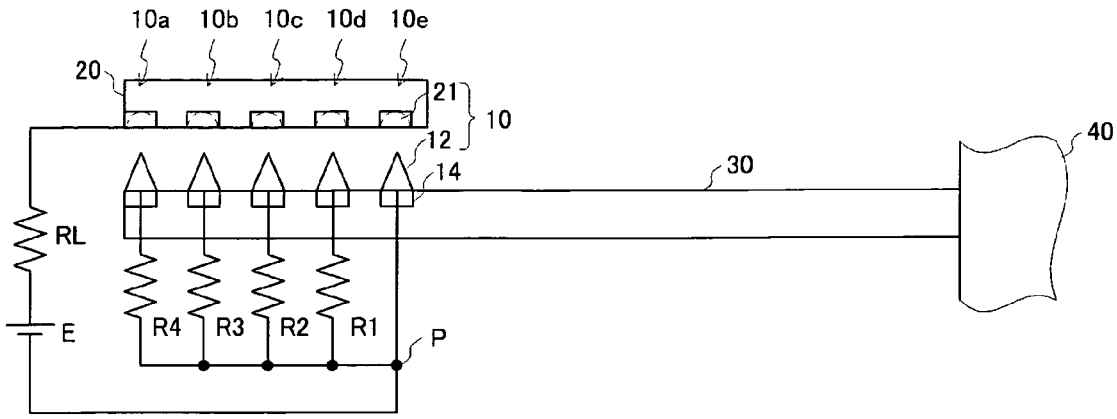
FIG. 15 schematically illustrates the operation of the switch employed in the second exemplary embodiment.

FIG. 15 schematically illustrates the operation of the switch employed in the second exemplary embodiment. In FIG. 15, the same components and configurations as those shown in FIG. 6 have the same reference numerals and a detailed explanation will be omitted. As compared to the switch employed in the first exemplary embodiment shown in FIG. 6, there are provided the beam portions 24 having the second contact portions 21 therein.

Figure 16:
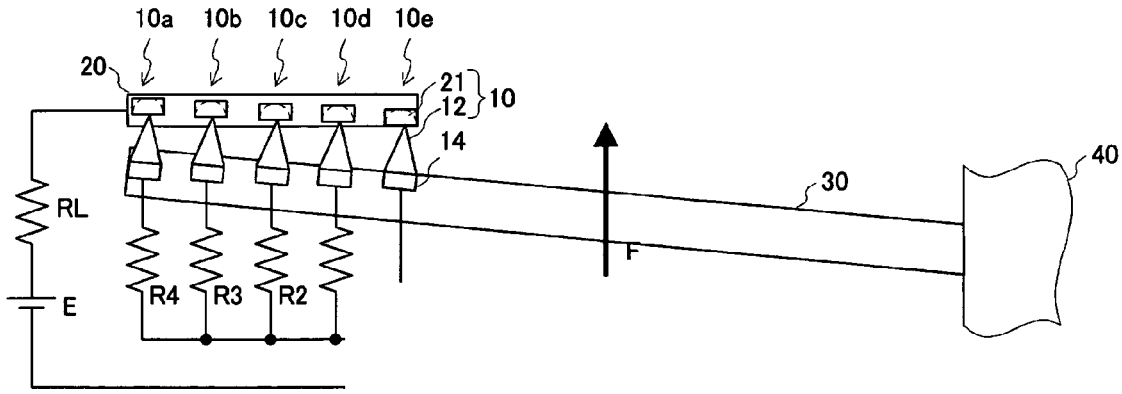
FIG. 16 schematically illustrates the operation of the switch employed in the second exemplary embodiment.

FIG. 16 illustrates all the contact switch portions 10*a* through 10*e* that are in a contact state. In FIG. 16, the same components and configurations as those shown in FIG. 15 have the same reference numerals and a detailed explanation will be omitted. In the contact switch portions 10*a* through 10*d* that have been already in a contact state, the beam portions 14 and the beam portions 24 serve as springs. The beam portions 24 having the second contact portions 21 therein also serve as springs in the second exemplary embodiment, whereas the beam portions 14 having the first contact portions 12 therein serve as springs in the first exemplary embodiment shown in FIG. 7B. In light of the mechanical strength, the displacement of the beam portions 14 and that of the beam portions 24 can be made smaller than that in the first exemplary embodiment. It is therefore possible to reduce the length of the beam portions 14 and 24, thereby reducing the size of the switch.

Third Exemplary Embodiment

Figure 17:
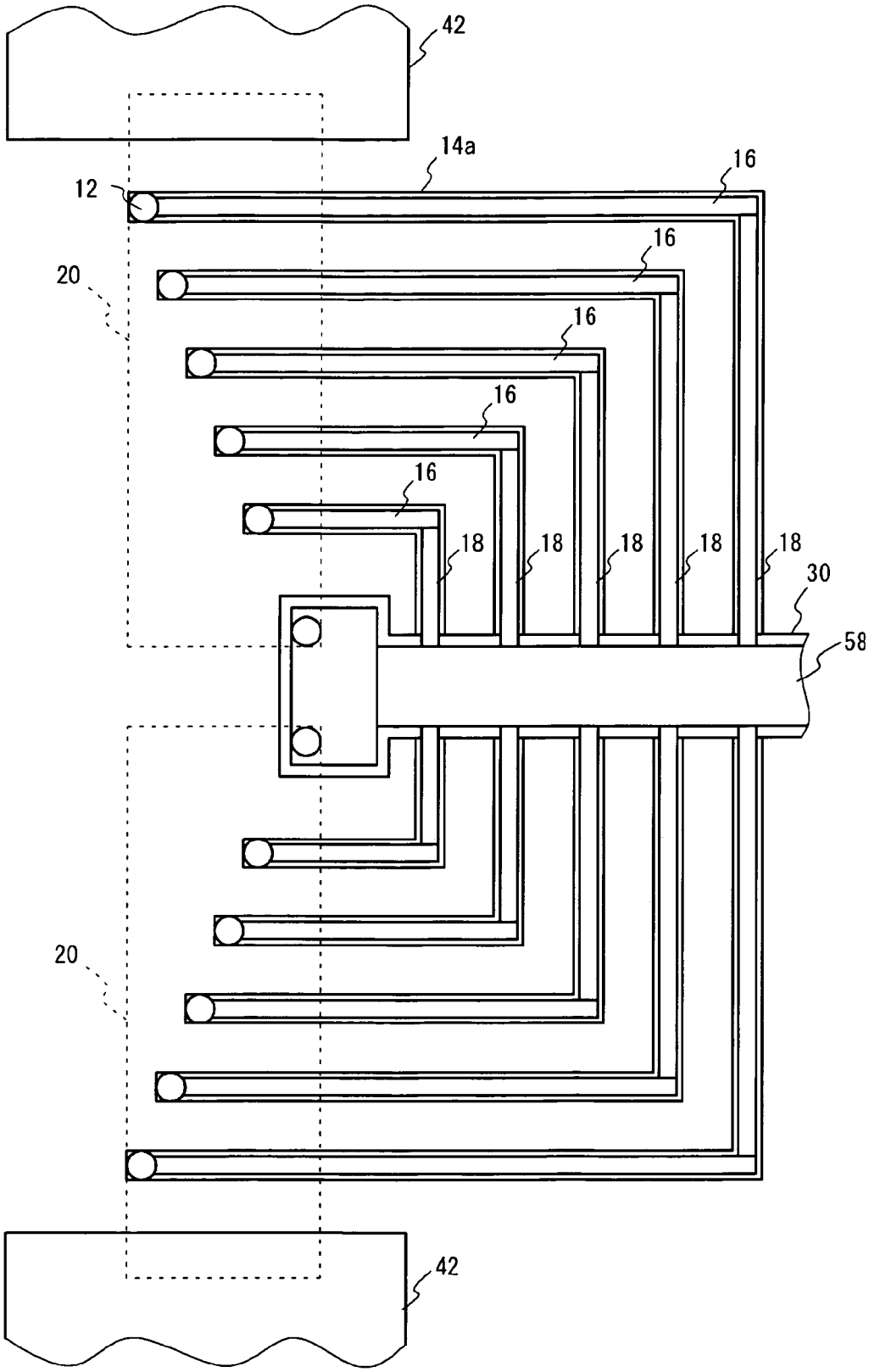
FIG. 17 is a top view of the first contact portions of the switch employed in a third exemplary embodiment.

A third exemplary embodiment of the present invention is an example in which the multiple contact switch portions 10 are arranged in a different direction from the direction of the fixing portion 40 of the first member 30 and the contact switch portions 10. FIG. 17 is a top view of the first contact portions 12 of the switch employed in the third exemplary embodiment. In FIG. 17, the same components and configurations as those shown in FIG. 5 have the same reference numerals and a detailed explanation will be omitted. Beam portions 14*a* are L-shaped, and one ends thereof are secured to the first member 30. There are provided the first contact portions 12 at the other ends of the beam portions 14*a*. Here, the first contact portions 12 are sequentially closer to the fixing portion 40 from the outside. The resistance metal films 16 formed on the beam portions 14*a* are coupled to the first contact portions 12, and are also coupled through the low-resistance metal films 18 to the extraction metal film 58. The second member 20 made up of the metal layer 68 is secured to the silicon substrate 60 by the fixing portion 42 above the first contact portions 12.

Figure 18A:
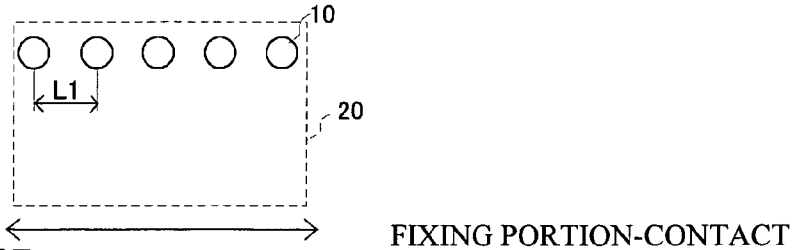
FIG. 18A through FIG. 18D illustrate the principle of the switch employed in the third exemplary embodiment.
Figure 18B:
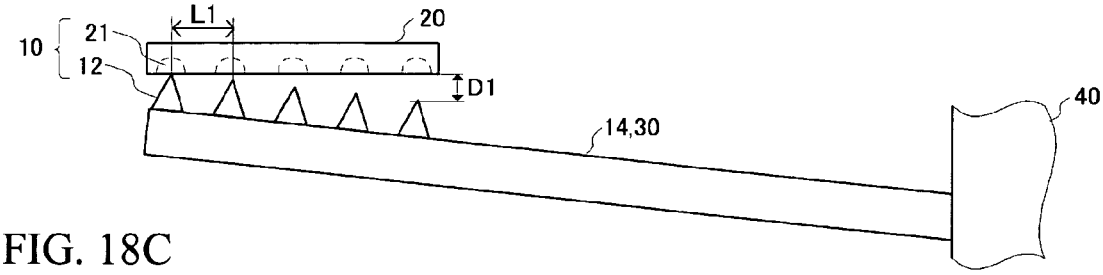
Figure 18C:
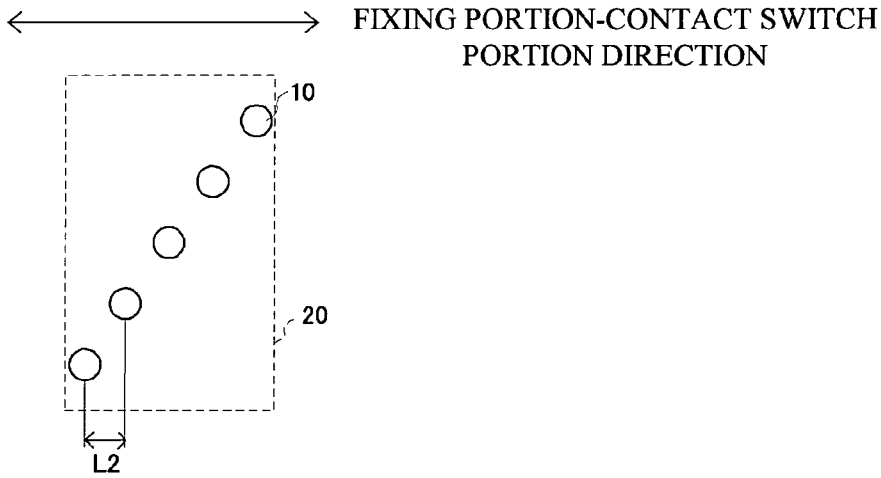
Figure 18D:
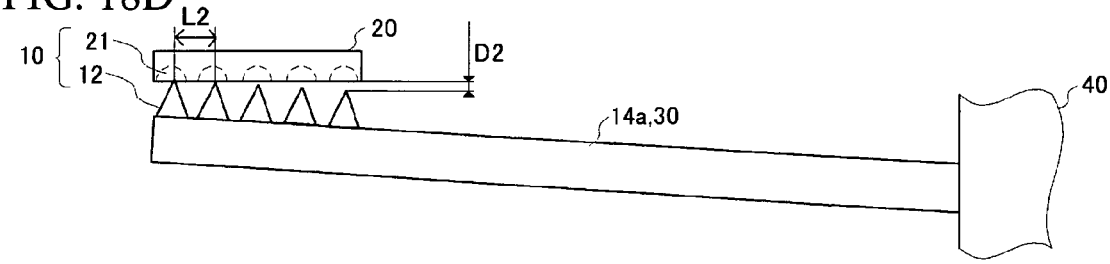

FIG. 18A through FIG. 18D illustrate the principle of the switch employed in the third exemplary embodiment. FIG. 18A illustrates the positional relationship of the second member 20 and the first contact portions 12, namely, the contact switch portions 10 employed in the first exemplary embodiment. FIG. 18B schematically illustrates one of the first contact portions 12 employed in the first exemplary embodiment connected to the second member 20. In a similar manner, FIG. 18C illustrates the positional relationship of the second member 20 and the first contact portions 12, namely, the contact switch portions 10 employed in the third exemplary embodiment. FIG. 18D schematically illustrates one of the first contact portions 12 employed in the third exemplary embodiment connected to the second member 20. Referring to FIG. 18A through FIG. 18D, multiple contact switch portions 10 are arranged in a direction of the fixing portion 40 of the first member 30 and the first contact portions 12, namely, the contact switch portions 10, (hereinafter, simply referred to as fixing portion-contact switch portion direction) in the first exemplary embodiment. In contrast, multiple contact switch portions 10 are arranged in a different direction of the above-described fixing portion-contact switch portion direction in the third exemplary embodiment. It is preferable that the distances between the contact switch portions 10 should be apart more than a given value. This is to dissipate the heat developed by the current flowing across the contact switch portions, and this is caused by the restrictions in the fabrication of the first contact portions 12. When L1 is a distance between the contact switch portions 10, L1 is the distance between the contact switch portions 10 in the fixing portion-contact switch portion direction in the first exemplary embodiment, as shown in FIG. 18A. In contrast, a distance L2 between the contact switch portions 10 in the fixing portion-contact switch portion direction can be made smaller than the distance L1 in the third exemplary embodiment.

As shown in FIG. 18B through FIG. 18D, when one of the contact switch portions 10 is in a contact state, distances D1 and D2 respectively denote the distances between the first contact portions 12 and the second contact portions 21 that are furthest away from each other in the first and third exemplary embodiments. In the third exemplary embodiment, the contact switch portions 10 are arranged in a different direction from the direction of the fixing portion 40 of the first member 30 and the contact switch portions 10. It is therefore possible to shorten the distances between the contact switch portions 10 in the fixing portion-contact switch portion direction to be the distance L2 in the third exemplary embodiment, whereas the distances between the contact switch portions 10 in the fixing portion-contact switch portion direction are L1 in the first exemplary embodiment. This makes it possible to make the distance D2 in the third exemplary embodiment shorter than the distance D1 in the first exemplary embodiment. Thus, the switch can be downsized.

Fourth Exemplary Embodiment

Figure 19C:
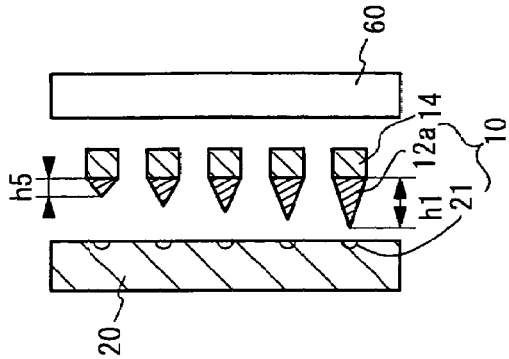
FIG. 19C is a cross-sectional view taken along the line H-H shown in FIG. 19A.
Figure 19A:
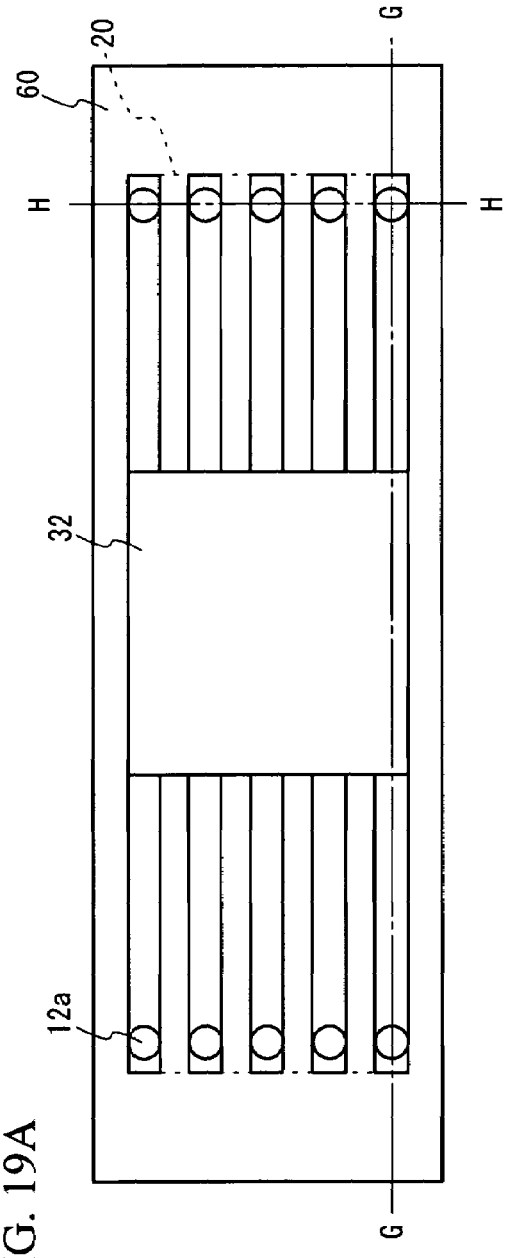
FIG. 19A is a top view of the switch employed in a fourth exemplary embodiment (the second member is not shown)
Figure 19B:
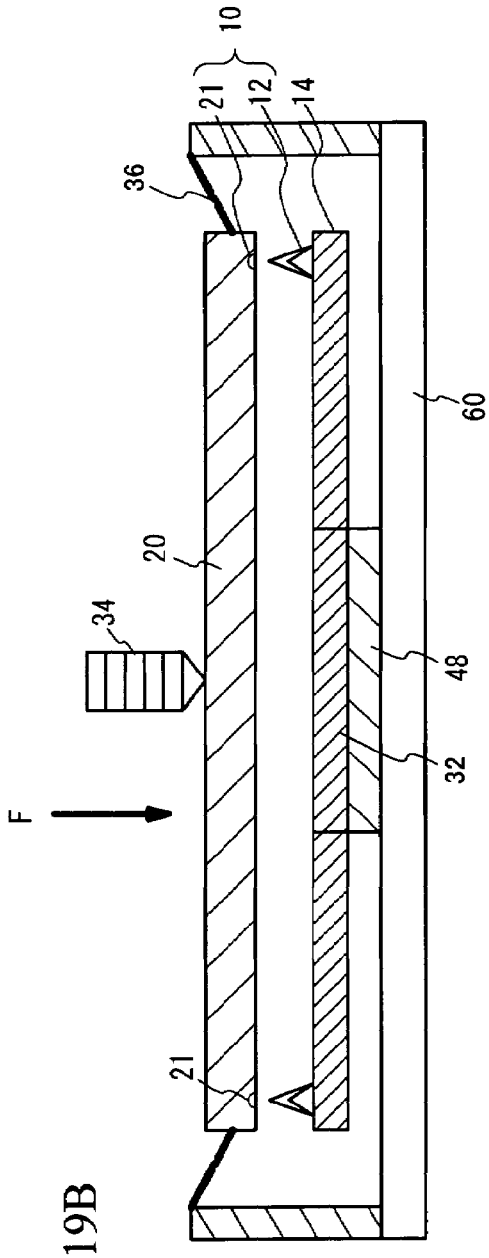
FIG. 19B is a cross-sectional view taken along the line G-G shown in FIG. 19A.

A fourth exemplary embodiment of the present invention is an example in which the first contact portions 12 have different heights. FIG. 19A is a top view of the switch employed in the fourth exemplary embodiment, whereas the second member 20 is not shown. FIG. 19B is a cross-sectional view taken along the line G-G shown in FIG. 19A. FIG. 19C is a cross-sectional view taken along the line H-H shown in FIG. 19A. Referring to FIG. 19A through FIG. 19C, a first member 32 is secured through a fixing portion 48 onto the silicon substrate 60. There are provided: the beam portions 14, one ends of which are secured to the first member 30; and the first contact portions 12 arranged at the ends of the beam portions 14. Above the first contact portions 12, there is provided the second member 20 having the second contact portions 21 therein to be in contact with the first contact portions 12. The first contact portions 12 and the second contact portions 21 compose the contact switch portions 10. The second member 20 is coupled through springs 36 to the silicon substrate 60, and a force F is exerted downward by a piezo drive device 34.

Figure 20:
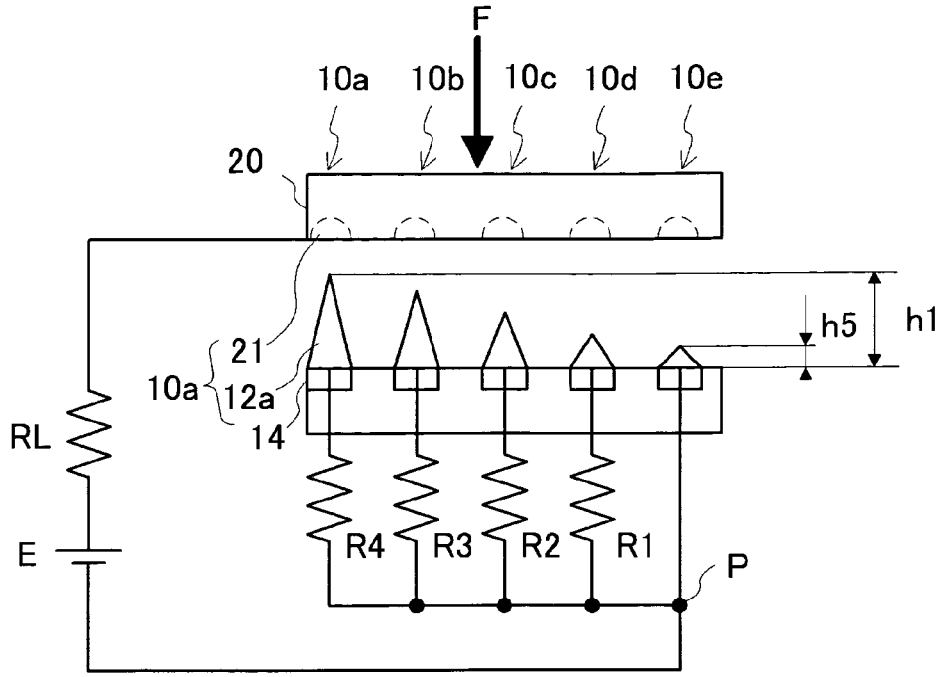
FIG. 20 schematically illustrates the operation of the switch employed in the fourth exemplary embodiment.

FIG. 20 schematically shows the operation of the switch employed in the fourth exemplary embodiment. In FIG. 20, the same components and configurations as those shown in FIG. 6 have the same reference numerals and a detailed explanation will be omitted. Referring to FIG. 20, the first contact portions 12 respectively provided at the beam portions 14 have different heights h1 through h5. The contact switch portions 10*a* through 10*e*, therefore, are sequentially in a contact state in this order during the switch ON operation period, whereas the contact switch portions 10*e* through 10*a* sequentially become in a non-contact state in this order during the switch OFF operation period. The contact switch portions 10*a* through 10*e* are connected in parallel, and the resistors R1 through R4 are respectively arranged between the contact switch portions 10*a* through 10*e* and the common connection point P coupled to the contact switch portions 10*a* through 10*e*. Here, the contact switch portion 10*e* is coupled through the low-resistance metal film to the common connection point P, and the resistance value is low between the contact switch portion 10*e* and the common connection point P.

Fifth Exemplary Embodiment

Figure 21:
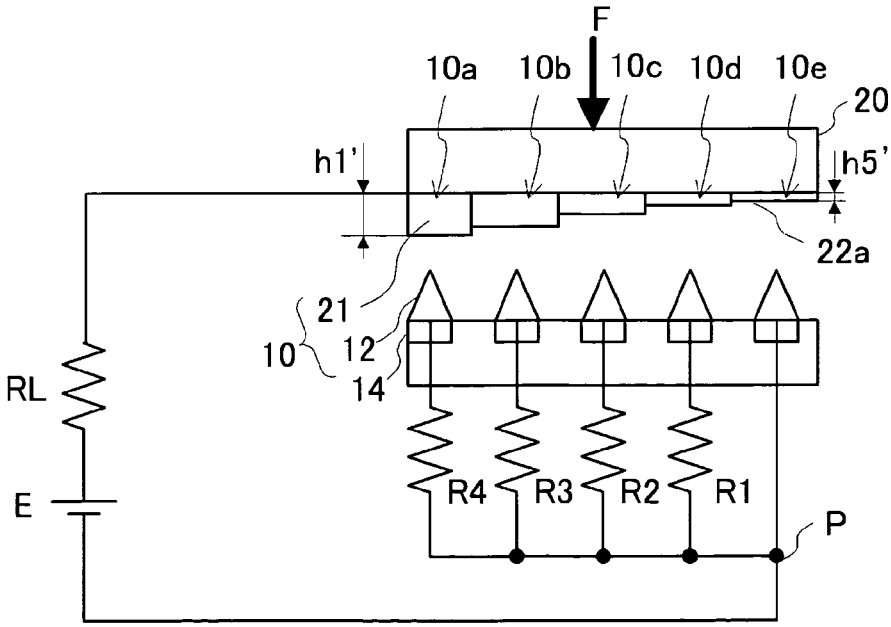
FIG. 21 schematically illustrates the operation of the switch employed in a fifth exemplary embodiment.

A fifth exemplary embodiment of the present invention is an example in which the second contact portions 21 have different heights. FIG. 21 schematically illustrates the operation of the switch employed in the fifth exemplary embodiment. In FIG. 21, the same components and configurations as those shown in FIG. 20 have the same reference numerals and a detailed explanation will be omitted. The second contact portions 21 provided at the second member 20 have different heights h1' through h5'. The contact switch portions 10*a* through 10*e*, therefore, are sequentially in a contact state in this order during the switch ON operation period, whereas the contact switch portions 10*e* through 10*a* are sequentially in a non-contact state in this order during the switch OFF operation period. The contact switch portions 10*a* through 10*e* are connected in parallel, and the resistors R1 through R4 are respectively arranged between the common connection point P and the contact switch portions 10*a* through 10*e*. Here, the contact switch portion 10*e* is coupled through the low-resistance metal film to the common connection point P, and the resistance value is low between the contact switch portion 10*e* and the common connection point P.

In the switches employed in the fourth and fifth exemplary embodiments, as shown in FIG. 20 and FIG. 21, the multiple first contact portions 12 or the multiple second contact portions 21 have different heights. When the contact switch portion 10*a* that is at least one of the multiple contact switch portions 10*a* through 10*e*, the contact switch portions 10*b* through 10*e* are in a non-contact state. The contact switch portion 10*e* that is at least one of the contact switch portions 10*b* through 10*e* that are in a non-contact state has a low resistance value, which is smaller than that of the resistor R4 corresponding to the contact switch portion 10*a*. It is therefore possible to suppress the peak of the power consumption of the contact switch portions during the ON operation period, and thereby suppressing the meltdown of the contact switch portions. One ends of the first contact portions 12 are provided at the beam portions 14 (first beam portion) secured to the first member 30. The beam portions 14 serve as springs, making it possible to connect the multiple contact switch portions smoothly. With such a simple configuration, the peak of the power consumption can be suppressed at the contact switch portions during the ON operation period, enabling hot switching. At least one of the first contact portions 12 or the second contact portions 21 respectively have different heights, the above-described effects are available.

Sixth Exemplary Embodiment

Figure 22:
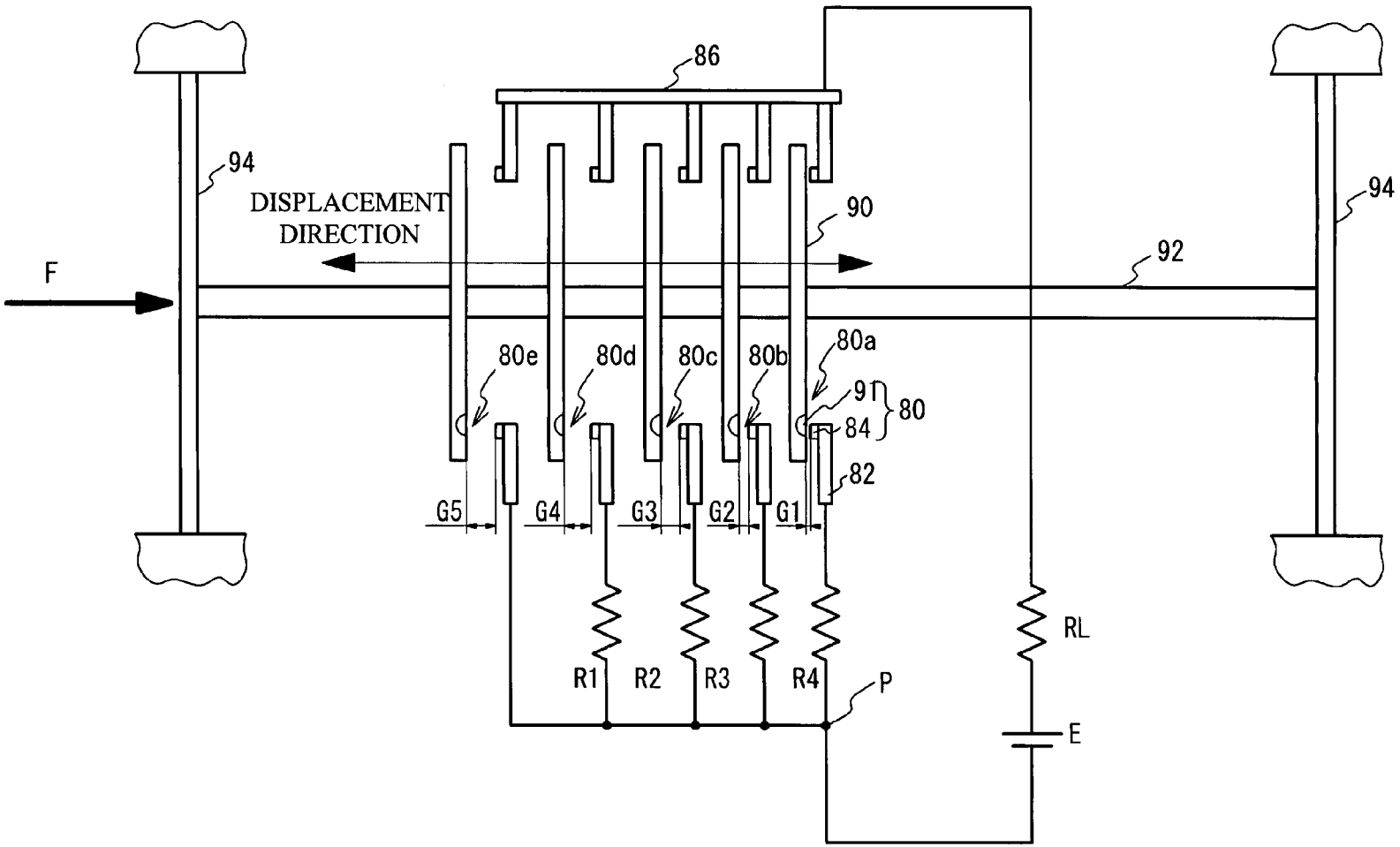
FIG. 22 is a top view of the switch employed in a sixth exemplary embodiment.

A sixth exemplary embodiment of the present invention is an example in which the multiple first contact portions 12 and the multiple second contact portions 21 are in a contact state or in a non-contact state in an arrangement direction of the contact switch portions 10. FIG. 22 is a top view of the switch employed in the sixth exemplary embodiment. A first member 92 is arranged between members 94, both ends of which are secured to the first member 92. There are provided multiple beam portions 90, one ends of which are secured onto the first member 92. The multiple beam portions 90 are respectively provided with first contact portions 91. The first contact portions 91 are in a contact state or in a non-contact state by second contact portions 84. The first contact portions 91 and the second contact portion s84 respectively compose contact switch portions 80*a* through 80*e*. The second contact portions 84 are secured to beam portions 82. There is provided a member 86 having contact portions to be coupled to the beam portions 90 in a similar manner as the second contact portions 84 on the opposite side of the first contact portions 91 with respect to the beam portions 90. Distances G1 through G5 between the first contact portions 91 and the second contact portions 84 are sequentially longer in the order of the distances G1 through G5. When the first member 92 is displaced toward in directions of arrows, the contact switch portions 80*a* through 80*e* having the distances G1 through G5 are sequentially in a contact state, or the contact switch portions 80*e* through 80*a* are sequentially in a non-contact state. The contact switch portions 80*a* through 80*e* are connected in parallel, and there are provided the resistors R1 through R4 respectively between the contact switch portions 80*a* through 80*e* and the common connection point P coupled to the contact switch portions 80*a* through 80*e*. Here, the contact switch portion 80*e* is coupled through the low-resistance metal film to the common connection point P, so the resistance value is low between the contact switch portion 80*e* and the common connection point P.

In accordance with the sixth exemplary embodiment, the distances between the multiple first contact portions 91 and the multiple second contact portions 84 are respectively different, and the first contact portions 91 and the second contact portions 84 are in a contact state or in a non-contact state in the arrangement direction of the contact switch portions 80*a* through 80*e*. For this reason, when at least one of the multiple contact switch portions 80*a* through 80*e*, namely, the contact switch portion 80*a*, there are the contact switch portions 80*b* through 80*e* that are not in a non-contact state. The resistor corresponding to at least one of the contact switch portions 80*b* through 80*e* that are not connected, namely, the contact switch portion 80*e*, has a low resistance value, and is smaller than that of the resistor R4 corresponding to the contact switch portion 80*a*. It is therefore possible to suppress the peak of the power consumption at the contact switch portions during the ON operation period, thereby suppressing the meltdown of the contact switch portions. Also, the first contact portions 91 are provided at the beam portions 90 (first beam portion) secured to the first member 92, and the beam portions 90 serve as springs, allowing the multiple contact switch portions 80 to be connected smoothly. With such configuration, the peak of the power consumption can be suppressed at the contact switch portions during the ON operation period, enabling hot switching.

Seventh Exemplary Embodiment

Figure 23:
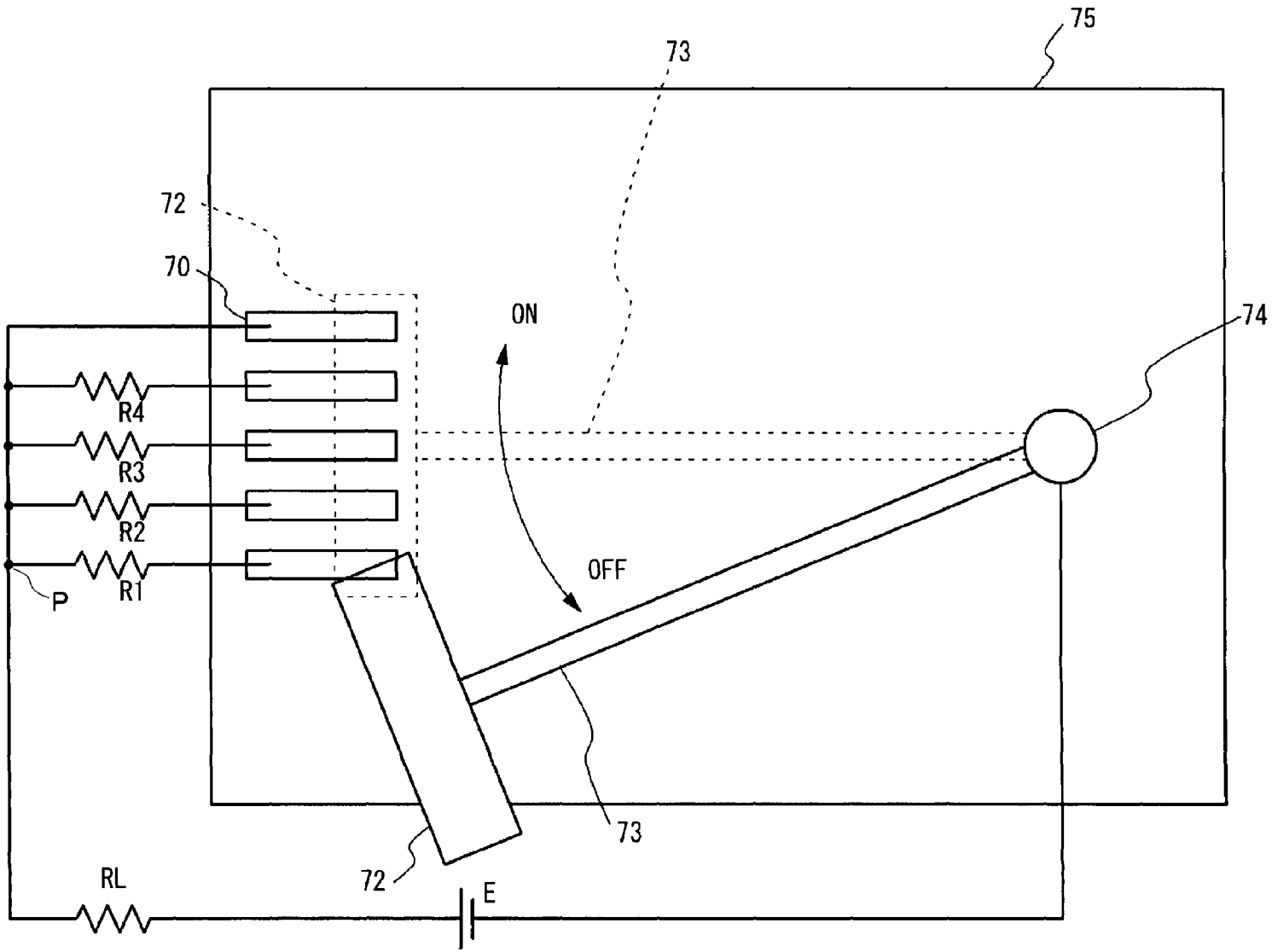
FIG. 23 is a top view of the switch in accordance with a seventh exemplary embodiment.
Figure 24:
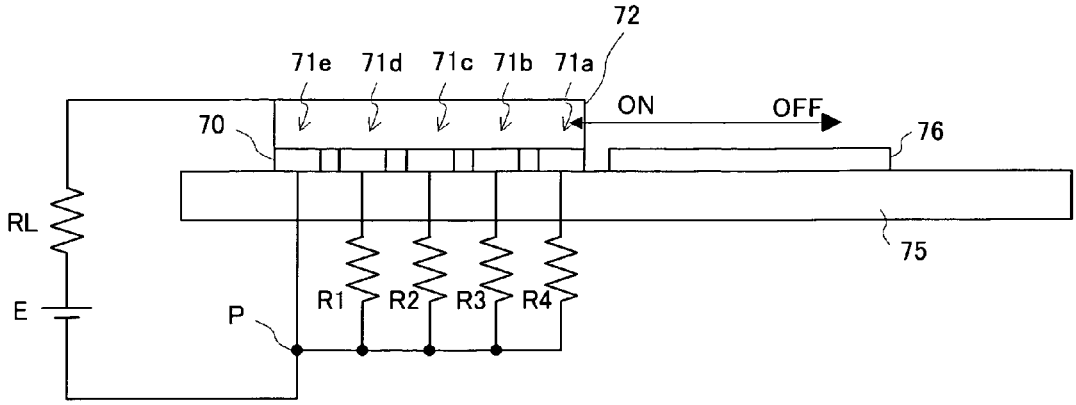
FIG. 24 schematically illustrates the operation of the switch in accordance with the seventh exemplary embodiment.

A seventh exemplary embodiment of the present invention is an example in which multiple second contact portions 70 are sequentially in contact with the first contact portion 72 by sliding a first member 73. FIG. 23 is a top view of the switch in accordance with the seventh exemplary embodiment. FIG. 24 schematically illustrates the operation of the switch in accordance with the seventh exemplary embodiment. There are provided multiple second contact portions 70 on a silicon substrate 75 or on the second member secured to the silicon substrate 75. The first contact portion 72 is secured to the first member 73. The first contact portion 72 and the second contact portions 70 compose contact switch portions 71. The first member 73 rotates with a fixed point 74 secured to the silicon substrate 60 being centered. With the afore-mentioned configuration, the first contact portion 72 slides in the arrangement direction of the second contact portions 70. Multiple second contact portions 70 are sequentially in contact with the first contact portion 72, and contact switch portions 71*a* through 71*e* are sequentially in a contact state in the order of the contact switch portions 71*a* through 71*e*. When the first contact portion 72 slides in an opposite direction, the contact switch portions 71*e* through 71*a* are sequentially in a non-contact state in the order of the contact switch portions 71*e* through 71*a*. The contact switch portions 71*a* through 71*e* are connected in parallel, and there are provided the resistors R1 through R4 respectively between the contact switch portions 71*a* through 71*e* and the common connection point P coupled to the contact switch portions 71*a* through 71*e*. Here, the contact switch portion 71*e* is coupled through a low-resistance metal film to the common connection point P, so the resistance value is low between the contact switch portion 71*e* and the common connection point P.

In accordance with the seventh exemplary embodiment, the contact switch portions 71*a* through 71*e* are in a contact state or in a non-contact state by sliding the first contact portion 72 in the arrangement direction of the multiple second contact portions 70. For this reason, when at least one of the multiple contact switch portions 71*a* through 71*e*, namely, the contact switch portion 71*a* is in a contact state, there are the switch portions 71*b* through 71*e* that are in a non-contact state. The resistor corresponding to at least one of the switch portions 71*b* through 71*e* that are in a non-contact state, namely, the contact switch portion 71*e*, has a low resistance value, and is smaller than that of the resistor R4 corresponding to the contact switch portion 71*a*. It is therefore possible to suppress the peak of the power consumption at the contact switch portions during the ON operation period, thereby suppressing the meltdown of the contact switch portions 71. With such configuration, the peak of the power consumption can be suppressed at the contact switch portions 71 during the ON operation period, enabling hot switching.

The first contact portion 72 slides when the first member 73 having the first contact portion 72 secured thereto rotates with centering around the fixed point 74 secured to the silicon substrate 75. With such configuration, it is possible to configure the switch that enables hot switching in an easy manner. In the seventh exemplary embodiment, the first member 73 slides in the arrangement direction of the second contact portions 70. However, the same effect is available when at least one of the first member 73 and the member to which the second contact portions 70 are secured, for example, the silicon substrate 75.

In the first through seventh exemplary embodiments, the description has been given of a case where there are provided five contact switch portions. However, the number of the contact switch portions is not limited to five. Two or more contact switch portions bring the same effect. It is preferable that there are provided three or more contact switch portions.

Finally, various aspects of the present invention are summarized in the following.

There is provided a switch including: a first member, one end of which being secured to a substrate; multiple first beam portions respectively having multiple first contact portions, one ends of the multiple beam portions being secured to the first member; multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled, wherein when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

In the above-described switch, when at least one of the multiple contact switch portions is in a contact state, a first surface of the first member in which the multiple first contact portions may be provided tilts toward a second surface in which the multiple second contact portions are provided. The multiple contact switch portions can be in a contact state sequentially, thereby suppressing the meltdown of the contact switch portions during the ON operation period.

In the above-described switch, the first member may move in a direction substantially perpendicular to a surface of the substrate, and the multiple first contact portions and the multiple second contact portions may move in the direction substantially perpendicular to the surface of the substrate to be in a contact state or in a non-contact state. The multiple contact switch portions may be arranged in a direction of a fixing portion of the first member and the multiple contact switch portions. By moving the first member, the surface of the first member on which the first contact portions are provided can be tilted toward the surface on which the second contact portions are provided, when at least one of the contact switch portions is in a contact state.

In the above-described switch, the multiple contact switch portions may be arranged in a different direction from a fixing portion of the first member and the multiple contact switch portions. It is only necessary that the first member move a small distance. In consideration of the mechanical strength of the first member, the first member can be shortened and the switch and be miniaturized.

The above-described switch may further include: a second member secured to the substrate; and multiple second beam portions in which the multiple second contact portions are respectively provided and one ends of which are secured to the second member. It is possible to reduce the displacement of the first beam portions and the second beam portions, allowing the first beam portions and the second beam portions to be shortened. The switch can be miniaturized.

The present invention is based on Japanese Patent Application No. 2005-295654 filed on Oct. 7, 2005, the entire disclosure of which is hereby incorporated by reference.

What is claimed is:

1. A switch comprising:

a first member, one end of which being secured to a substrate;

multiple first beam portions respectively having multiple first contact portions, one ends of the multiple beam portions being secured to the first member;

multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled, wherein when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

2. The switch as claimed in claim 1, wherein when at least one of the multiple contact switch portions is in a contact state, a first surface of the first member in which the multiple first contact portions are provided tilts toward a second surface in which the multiple second contact portions are provided.

3. The switch as claimed in claim 1, wherein the first member moves in a direction substantially perpendicular to a surface of the substrate, and the multiple first contact portions and the multiple second contact portions move in the direction substantially perpendicular to the surface of the substrate to be in a contact state or in a non-contact state.

4. The switch as claimed in claim 1, wherein the multiple contact switch portions are arranged in a direction of a fixing portion of the first member and the multiple contact switch portions.

5. The switch as claimed in claim 1, wherein the multiple contact switch portions are arranged in a different direction from a fixing portion of the first member and the multiple contact switch portions.

6. The switch as claimed in claim 1, further comprising:

a second member secured to the substrate; and multiple second beam portions in which the multiple second contact portions are respectively provided and one ends of which are secured to the second member.

7. A switch comprising:

multiple first beam portions respectively having multiple first contact portions, one ends of the multiple beam portions being secured to the first member;

multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled, wherein:

at least one of the multiple first contact points and the multiple second contact portions have different heights; and when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

8. A switch comprising:

multiple first beam portions respectively having multiple first contact portions, one ends of the multiple beam portions being secured to the first member;

multiple contact switch portions connected in parallel, the multiple first contact portions and multiple second contact portions being in a contact state or in a non-contact state in the multiple contact switch portions; and resistors arranged respectively between the multiple contact switch portions and a common connection point to which the multiple contact switch portions are coupled, wherein:

the multiple first contact portions and the multiple second contact portions are in a contact state or in a non-contact state in an arrangement direction of the contact switch portions; and when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

9. A switch comprising:

multiple contact switch portions connected in parallel and being in a contact state or in a non-contact state by sliding at least one of a first contact portion and multiple second contact portions in an arrangement direction of the multiple second contact portions; and resistors arranged respectively between the multiple contact switch portions and a common connection point to which the multiple contact switch portions are coupled, wherein when at least one of the multiple switch portions is in a contact state, one of the resistors corresponding to the at least one of the multiple switch portions in a contact state has a resistance value greater than another one of the resistors corresponding to at least one of the multiple contact switch portions that is in a non-contact state.

10. The switch as claimed in claim 9, wherein a member to which at least one of the first contact portion and the multiple second contact portions are secured rotates with a fixed point secured to a substrate being centered, so that at least one of the first contact portion and the multiple second contact portions slide.

11. The switch as claimed in claim 1, wherein resistance values of the resistors are smaller in the order that the corresponding contact switch portions are in a contact state.

12. The switch as claimed in claim 1, wherein when at least one of the multiple switch portions is in a non-contact state, one of the resistors corresponding to the at least one of the multiple switch portions in a non-contact state has a resistance value smaller than another one of the resistors corresponding to at least one of the multiple contact switch portions that is in a contact state.

* * * * *